US011226134B2

(12) United States Patent
Kawada

(10) Patent No.: US 11,226,134 B2
(45) Date of Patent: Jan. 18, 2022

(54) HEAT EXCHANGER FOR GAS APPLIANCE AND METHOD FOR MANUFACTURING HEAT EXCHANGER FOR GAS APPLIANCE

(71) Applicant: PALOMA CO., LTD., Nagoya (JP)

(72) Inventor: Tsuyoshi Kawada, Nagoya (JP)

(73) Assignee: PALOMA CO., LTD., Nagoya (JP)

( * ) Notice: Subject to any disclaimer, the term of this patent is extended or adjusted under 35 U.S.C. 154(b) by 0 days.

(21) Appl. No.: 16/828,579

(22) Filed: Mar. 24, 2020

(65) Prior Publication Data

US 2020/0309408 A1 Oct. 1, 2020

(30) Foreign Application Priority Data

Mar. 29, 2019 (JP) ..... JP2019-067276

(51) Int. Cl.

| | |
|---|---|
| ***F24H 1/12*** | (2006.01) |
| ***F24H 1/14*** | (2006.01) |
| ***F24H 9/18*** | (2006.01) |
| ***F24H 9/14*** | (2006.01) |
| ***F24H 9/06*** | (2006.01) |
| ***F28F 9/02*** | (2006.01) |
| ***F28F 9/00*** | (2006.01) |

(52) U.S. Cl.

CPC ..... *F24H 1/124* (2013.01); *F24H 1/145* (2013.01); *F24H 9/06* (2013.01); *F24H 9/146* (2013.01); *F24H 9/1836* (2013.01); *F28F 9/001* (2013.01); *F28F 9/02* (2013.01)

(58) Field of Classification Search

CPC ..... F28D 7/0075; F28D 7/087; F24H 1/523; F24H 1/124; F24H 9/1836; F24H 1/145; F24H 9/06; F24H 9/146; F24H 9/00; F24H 1/14; B65D 88/744; F28F 9/02; F28F 9/001

See application file for complete search history.

(56) References Cited

U.S. PATENT DOCUMENTS 3,724,426 A * 4/1973 Brown ..... F17C 7/04 122/33

FOREIGN PATENT DOCUMENTS

| | | | |
|---|---|---|---|
| JP | 2013072569 A | * | 3/2013 |
| JP | 2013-130348 A | | 7/2013 |
| JP | 2017026286 A | * | 2/2017 |

* cited by examiner

*Primary Examiner* — Edelmira Bosques
*Assistant Examiner* — Benjamin Trettel
(74) *Attorney, Agent, or Firm* — Smith, Gambrell & Russell, LLP

(57) ABSTRACT

A secondary heat exchanger includes a case and a first heat transfer tube portion. The case includes a box body and a first closing member. The box body is provided with a second opening on one side in a third direction. A first assembly in which the first heat transfer tube portion and the first closing member are assembled integrally is mounted to the box body so that a plurality of first heat transfer tubes are is inserted into the box body from the second opening and so that the second opening is closed by the first closing member.

3 Claims, 13 Drawing Sheets

HEAT EXCHANGER FOR GAS APPLIANCE AND METHOD FOR MANUFACTURING HEAT EXCHANGER FOR GAS APPLIANCE

CROSS-REFERENCE TO RELATED APPLICATIONS

This application is based upon and claims the benefit of priority from the prior Japanese Patent Application No. 2019-067276 filed on Mar. 29, 2019, the entire contents of which are incorporated herein by reference.

BACKGROUND OF THE INVENTION

(1) Field of the Invention

The present disclosure relates to a heat exchanger for a gas appliance and a method for manufacturing the heat exchanger for the gas appliance.

(2) Description of Related Art

Conventionally, heat exchangers for gas appliances used for gas appliances such as hot water supply apparatuses are known. For example, a heat exchanger for a gas appliance disclosed in Japanese Unexamined Patent Application Publication No. 2013-130348 includes a casing whose inside is a passage for exhaust gas (combustion exhaust), and a heat transfer tube portion (heat absorption tube) accommodated in the casing. Water in the heat transfer tube portion (heat absorption tube) is heated by heat of the exhaust gas (combustion exhaust) introduced into the casing. The heat exchanger disclosed in Japanese Unexamined Patent Application Publication No. 2013-130348 is formed by drawing process into a box shape in which an upper surface of a case body constituting the casing is opened, and a side wall on one side of a right-left direction in the case body has upstream end-inserting holes and a downstream end-inserting holes formed with an interval therebetween in a front-rear direction.

SUMMARY OF THE INVENTION

In the heat exchanger in which the case body is formed by drawing process as described above, a configuration to avoid interference between the case body and the heat transfer tube portion (heat absorption tube) is required as a configuration for assembling the heat transfer tube portion (heat absorption tube) in the box-shaped case body. Specifically, such a configuration is conceivable that the heat transfer tube portion (heat absorption tube) is made slightly small in size so as not to interfere with the case body during assembly (during insertion through an opening), and in the assembly, the heat transfer tube portion (heat absorption tube) is inserted into the case body while being inclined obliquely and is moved so as to slide outward so that an end of the heat transfer tube portion (heat absorption tube) is attached to each insertion hole (upstream end-inserting hole and downstream end-inserting hole). However, when such a mounting structure is adopted, a spare space (a space in which no heat transfer tube portion is present in the case body) is generated as much as necessary to avoid interference during assembly. If there is such a spare space, a part of exhaust gas (combustion exhaust) that has entered the casing easily flows into the spare space, and therefore, there is a concern that the gas is not efficiently in contact with or does not approach the heat transfer tube portion (heat absorption tube), resulting in lower thermal efficiency.

On the other hand, in the heat exchanger disclosed in Japanese Unexamined Patent Application Publication No. 2013-130348, a spacer (baffle plate) is disposed so as to fill the spare space to prevent gas from flowing into the spare space. However, when the spacer is disposed in this way, materials are added and the weight is increased, correspondingly.

Thus, in order to solve at least one of the above-described problems, the present disclosure realizes a technology of enabling to suppress a dead space where no heat transfer tube portion is present in a heat exchanger for a gas appliance including a case body (main body portion) formed by drawing process.

A heat exchanger for a gas appliance according to a first aspect in the present disclosure includes a case and a heat transfer tube portion. The case includes a box having a main body portion and a lid portion. The main body portion is configured as a drawing formed body and in a box shape in which one side of a first direction is opened. The main body portion includes a first opening on one side of the first direction. The lid portion is attached to the main body portion so as to close the first opening. An inside of the box body is configured as a passage space for exhaust gas. The heat transfer tube portion includes a plurality of heat transfer tubes that is accommodated in the case.

In this heat exchanger for a gas appliance, the main body portion includes a peripheral wall portion surrounding the passage space and a bottom wall portion connected to a lower end side of the peripheral wall portion. The peripheral wall portion includes a flow inlet for exhaust gas that passes through the passage space, on an other side of the second direction intersecting the first direction, and a second opening on one side of a third direction intersecting the first direction and the second direction. The case includes a plate-shaped closing member. The closing member includes a first through hole group provided with a plurality of first through holes and a second through hole group provided with a plurality of second through holes. The first through hole group and the second through hole group are arranged apart from each other in the second direction. The plurality of heat transfer tubes is fixed to the closing member so that one side of each of the heat transfer tubes in the second direction is mounted in association with each of the first through holes of the first through hole group and the other side of each of the heat transfer tubes in the second direction is mounted in association with each of the second through holes of the second through hole group. An assembly in which the heat transfer tube portion and the closing member are assembled integrally is mounted to the box body so that the plurality of heat transfer tubes is inserted into the box body from the second opening and so that the second opening is closed by the closing member.

A heat exchanger for a gas appliance according to a second aspect in the present disclosure includes a case, a first heat transfer tube portion, and a second heat transfer tube portion. The case includes a box having a main body portion and a lid portion. The main body portion is configured as a drawing formed body and in a box shape in which one side of a first direction is opened. The main body portion includes a first opening on one side of the first direction. The lid portion is attached to the main body portion so as to close the first opening. An inside of the box body is configured as a passage space for exhaust gas. The heat transfer tube portion includes a plurality of heat transfer tubes that is accommodated in the case. The first heat transfer tube portion includes a plurality of first heat transfer tubes that is accommodated in the case. The second heat transfer tube portion includes a plurality of second heat transfer tubes that is accommodated in the case.

In this heat exchanger for a gas appliance, the main body portion includes a peripheral wall surrounding the passage space and a bottom wall portion connected to a lower end side of the peripheral wall portion. The peripheral wall portion includes a flow inlet for the exhaust gas on an other side of the second direction intersecting the first direction, a second opening on one side of a third direction intersecting the first direction and the second direction, and a third opening on the other side of the third direction. The case includes a plate-shaped first closing member, a plate-shaped second closing member, and a partition plate that partitions the inside of the box body. The partition plate is disposed so as to partition a first passage space and a second passage space. The first passage space is formed on the second opening side in the third direction. The second passage space is formed on the third opening side in the third direction. The first closing member includes a first through hole group provided with a plurality of first through holes and a second through hole group provided with a plurality of second through holes. The first through hole group and the second through hole group are arranged apart from each other in the second direction. The second closing member includes a third through hole group provided with a plurality of third through holes and a fourth through hole group provided with a plurality of fourth through holes. The third through hole group and the fourth through hole group are arranged apart from each other in the second direction. The plurality of first heat transfer tubes is fixed to the first closing member so that one side of each of the first heat transfer tubes in the second direction is mounted in association with each of the first through holes of the first through hole group and the other side of each of the first heat transfer tubes in the second direction is mounted in association with each of the second through holes of the second through hole group. The plurality of second heat transfer tubes is fixed to the second closing member so that one side of each of the second heat transfer tubes in the second direction is mounted in association with each of the third through holes of the third through hole group and the other side of each of the second heat transfer tubes in the second direction is mounted in association with each of the fourth through holes of the fourth through hole group. A first assembly in which the first heat transfer tube portion and the first closing member are assembled integrally is mounted to the box body so that the first heat transfer tube portion is inserted into the box body from the second opening and so that the second opening is closed by the first closing member and an end of the first heat transfer tube portion that is on an opposite side to the first closing member side is disposed close to the partition plate in the first passage space. A second assembly in which the second heat transfer tube portion and the second closing member are assembled integrally is mounted to the box body so that the second heat transfer tube portion is inserted into the box body from the third opening and so that the third opening is closed by the second closing member and an end of the second heat transfer tube that is on an opposite side to the second closing member side is disposed close to the partition plate in the second passage space.

A method for manufacturing a heat exchanger for a gas appliance according to a third aspect in the present disclosure is a method for manufacturing a heat exchanger for a gas appliance. The heat exchanger includes a case and a heat transfer tube portion. The case includes a box body having a main body portion and lid portion. The main body portion is configured as a drawing formed body and in a box shape in which one side of a first direction is opened. The main body portion includes a first opening on one side of the first direction. The lid portion is attached to the main body portion so as to close the first opening. An inside of the box body is configured as a passage space for exhaust gas. The heat transfer tube portion includes a plurality of heat transfer tubes that is accommodated in the case.

The manufacturing method includes a first forming step, a second forming step, a third forming step, a fixing step, and a mounting step.

In the first forming step, the main body portion is formed by drawing a metal plate. The main body portion includes a peripheral wall portion surrounding the passage space and a bottom wall portion connected to a lower end side of the peripheral wall portion. In the second forming step, in the peripheral wall portion, a flow inlet for the exhaust gas is formed on an other side of the second direction intersecting the first direction, and a second opening is formed on one side of a third direction intersecting the first direction and the second direction. In the third forming step, a plate-shaped closing member is formed. The closing member is formed with a first through hole group provided with a plurality of first through holes and a second through hole group provided with a plurality of second through holes so that the first through hole group and the second through hole group are apart from each other in the second direction. In the fixing step, the plurality of heat transfer tubes is fixed to the closing member so that one side of each of the heat transfer tubes in the second direction is mounted in association with each of the first through holes of the first through hole group and the other side of each of the heat transfer tubes in the second direction is mounted in association with each of the second through holes of the second through hole group. In the mounting step, an assembly in which the heat transfer tube portion and the closing member are assembled integrally is mounted to the box body in such a manner that the plurality of heat transfer tubes is inserted into the box body from the second opening and the second opening is closed by the closing member.

The technology according to the present disclosure can suppress a dead space where no heat transfer tube portion is present in a heat exchanger including a case body formed by drawing process.

DETAILED DESCRIPTION OF PREFERRED EMBODIMENTS

First Embodiment

A first embodiment will be described below with reference to FIGS. 1 to 12.

Configuration of Hot Water Supply Apparatus 1

Figure 1:
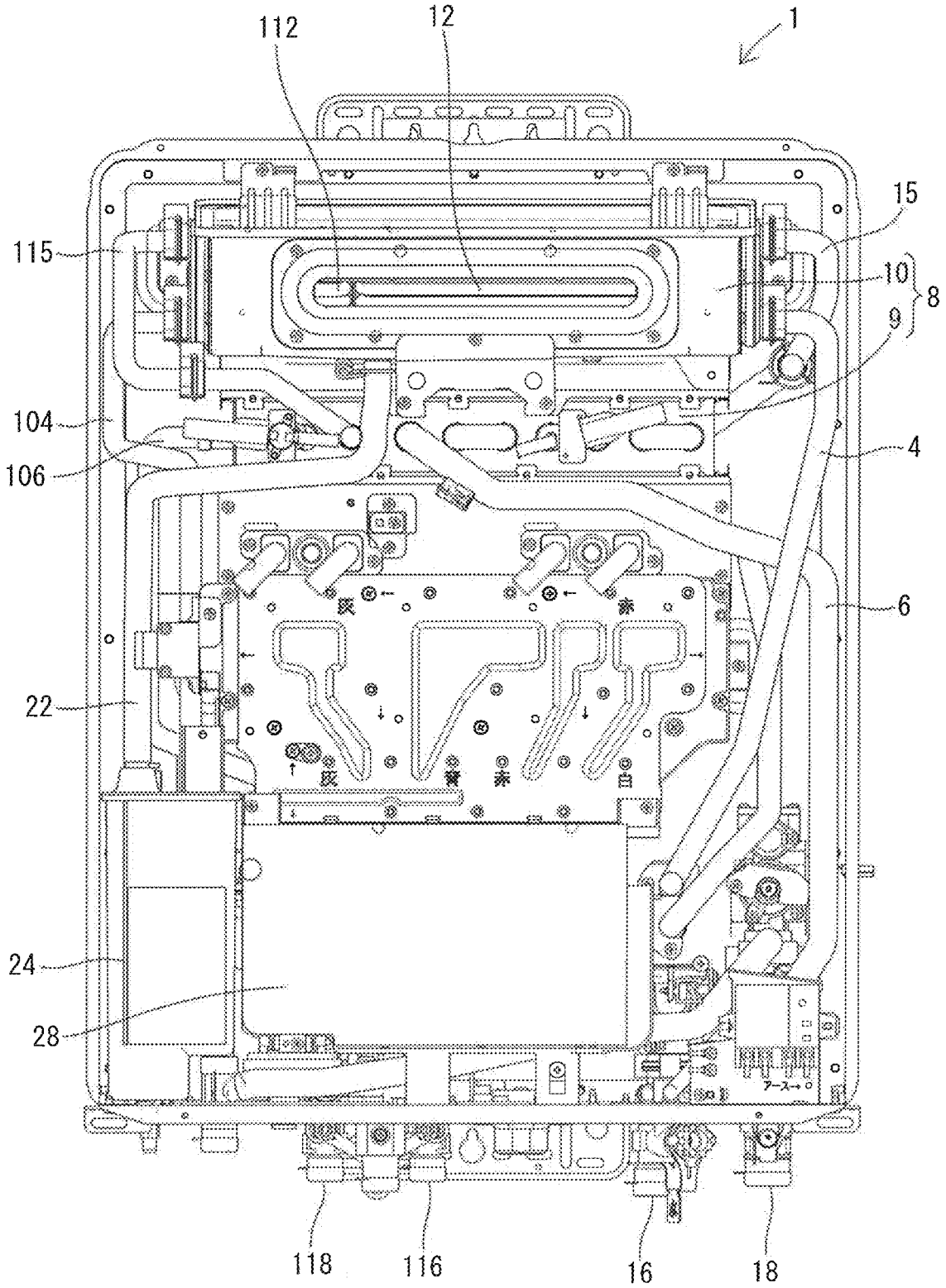
FIG. 1 is a front view schematically illustrating an internal structure of a hot water supply apparatus according to a first embodiment.
Figure 2:
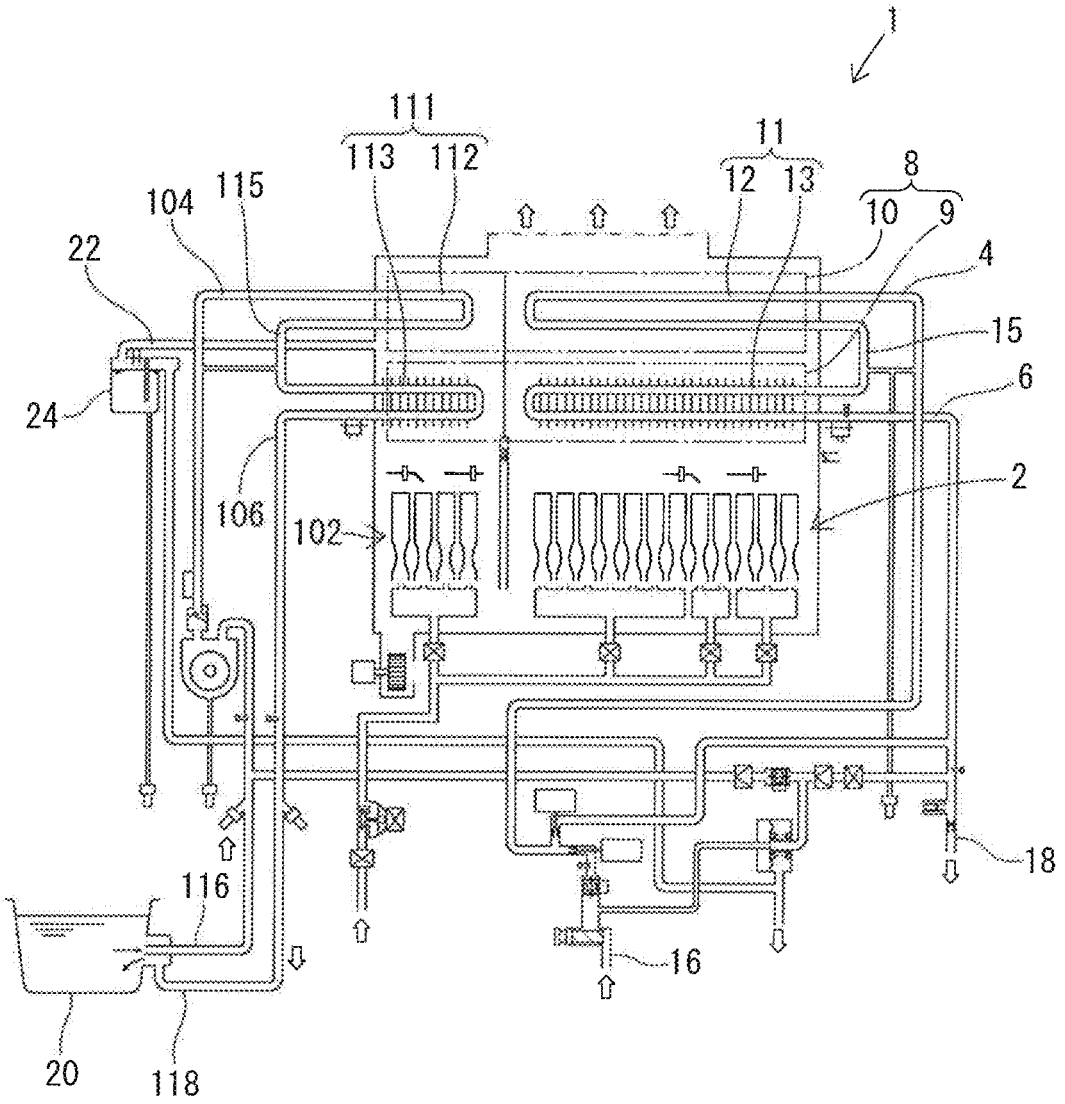
FIG. 2 is an explanatory diagram conceptually illustrating a configuration of the hot water supply apparatus.

A hot water supply apparatus 1 shown in FIGS. 1 and 2 includes a first gas burner 2, a water inflow tube 4, a hot-water outflow tube 6, a heat exchanger 8, a first connecting tube 15, and the like, and has a function of heating tap water supplied from the outside and supplying the heated water. The first gas burner 2 (hot water supply burner) is a part that burns combustion gas to generate combustion exhaust (exhaust gas). The water inflow tube 4 is configured as a path through which water flows from a water inlet 16, and the hot-water outflow tube 6 is configured as a path through which hot water is fed to a hot-water outlet 18. The heat exchanger 8 includes a hot water supply-side heat transfer tube portion 11 interposed between the water inflow tube 4 and the hot-water outflow tube 6, and is a part that functions to transfer heat, generated by combustion in the first gas burner 2, to water passing through the hot water supply-side heat transfer tube portion 11.

The heat exchanger 8 includes a primary heat exchanger 9 and a secondary heat exchanger 10. The primary heat exchanger 9 is disposed upstream side of a combustion exhaust path of the first gas burner 2. The secondary heat exchanger 10 is disposed downstream side of the combustion exhaust path. The hot water supply-side heat transfer tube portion 11 includes a first heat transfer tube portion 12 and a third heat transfer tube portion 13. The first heat transfer tube portion 12 is provided in the secondary heat exchanger 10, and the third heat transfer tube portion 13 is provided in the primary heat exchanger 9. The first heat transfer tube portion 12 of the secondary heat exchanger 10 is connected to the downstream side of the water inflow tube 4, and the first connecting tube 15 is connected to the downstream side of the first heat transfer tube portion 12. The third heat transfer tube portion 13 of the primary heat exchanger 9 is connected to the downstream side of the first connecting tube 15, and the hot-water outflow tube 6 is connected to the downstream side of the third heat transfer tube portion 13.

The heat exchanger 8 functions to recover sensible heat of combustion exhaust by the primary heat exchanger 9 and then recover latent heat by the secondary heat exchanger 10. Specifically, the primary heat exchanger 9 exchanges heat so as to transfer combustion heat contained in combustion exhaust generated in the first gas burner 2 to water passing through the third heat transfer tube portion 13, thereby transferring heat energy of sensible heat to passing water. The secondary heat exchanger 10 exchanges heat so as to transfer combustion heat, obtained after combustion exhaust generated in the first gas burner 2 passes through the primary heat exchanger 9, to water passing through the first heat transfer tube portion 12, thereby transferring heat energy of latent heat to passing water.

The hot water supply apparatus 1 includes a second gas burner 102, an outgoing pipe 104, a return pipe 106, a second connecting tube 115, and the like, and has a function of performing reheating of a bath using the heat exchanger 8 described above. The second gas burner 102 (bath burner) is a part that burns combustion gas to generate combustion exhaust (exhaust gas). The outgoing pipe 104 is a path that guides water from a bathtub 20 side to the heat exchanger 8 through an inlet 116. The return pipe 106 is a path that guides water from the heat exchanger 8 to the bathtub 20 side through an outlet 118. The heat exchanger 8 described above includes a bath-side heat transfer tube portion 111 interposed between the outgoing pipe 104 and the return pipe 106, and functions to transfer heat, generated by combustion in the second gas burner 102, to water passing through the bath-side heat transfer tube portion 111.

The bath-side heat transfer tube portion 111 includes a second heat transfer tube portion 112 and a fourth heat transfer tube portion 113. The second heat transfer tube portion 112 is provided in the secondary heat exchanger 10, and the fourth heat transfer tube portion 113 is provided in the primary heat exchanger 9. The second heat transfer tube portion 112 of the secondary heat exchanger 10 is connected to the downstream side of the outgoing pipe 104, and the second connecting tube 115 is connected to the downstream side of the second heat transfer tube portion 112. The fourth heat transfer tube portion 113 of the primary heat exchanger 9 is connected to the downstream side of the second connecting tube 115, and the return pipe 106 is connected to the downstream side of the fourth heat transfer tube portion 113.

The primary heat exchanger 9 described above exchanges heat so as to transfer combustion heat contained in combustion exhaust generated in the second gas burner 102 to water passing through the fourth heat transfer tube portion 113, thereby transferring heat energy of sensible heat to passing water. The secondary heat exchanger 10 exchanges heat so as to transfer combustion heat, obtained after combustion exhaust generated in the second gas burner 102 passes through the primary heat exchanger 9, to water passing through the second heat transfer tube portion 112, thereby transferring heat energy of latent heat to passing water.

The hot water supply apparatus 1 includes a drain pipe 22 and a neutralizer 24. The drain pipe 22 has an upstream side connected to a drain joint 26 (see FIG. 3) of the secondary heat exchanger 10 and a downstream side connected to the neutralizer 24. Drain water generated by recovery of latent heat in the secondary heat exchanger 10 is discharged to the outside of the secondary heat exchanger 10 through the drain joint 26 and sent to the neutralizer 24 through the drain pipe 22.

The hot water supply apparatus 1 further includes a controller 28 as a control device. The controller 28 is configured, for example, as a known microcomputer or the like, and configured to be capable of acquiring signals from various sensors provided in the hot water supply apparatus 1 and to be capable of controlling various actuators provided in the hot water supply apparatus 1. For example, when water flow in the water inflow tube 4 is detected by a water flow sensor (not shown), the hot water supply apparatus 1 operates the first gas burner 2 to generate hot water. As another example, when water flow in the outgoing pipe 104 is detected by a water flow sensor (not shown), the hot water supply apparatus 1 operates the second gas burner 102 to reheat a bath.

Configuration of Secondary Heat Exchanger 10

Next, a configuration of the secondary heat exchanger 10 will be described with reference to FIGS. 3 to 9. In the present embodiment, the vertical direction of the hot water supply apparatus 1 is a first direction, the upper side is one side of the first direction, and the lower side is the other side of the first direction. The first direction is a basic direction in the hot water supply apparatus 1. For example, in an installed state of the hot water supply apparatus 1, the first direction is a direction along a vertical up-down direction. A front-rear direction of the hot water supply apparatus 1 is a second direction, the front side (the front side of the drawing sheet of FIG. 1) is one side of the second direction, and the rear side is the other side of the second direction. A right-left direction of the hot water supply apparatus 1 is a third direction, the right side (the right side of the drawing sheet of FIG. 1) is one side of the third direction, and the left side is the other side of the third direction. The second direction is a direction that intersects (for example, is orthogonal to) the first direction. In the representative examples shown in FIGS. 3 and 4, the second direction is a direction orthogonal to the first direction. The third direction is a direction that intersects (for example, is orthogonal to) the first direction and the second direction. In the representative examples shown in FIGS. 3 and 4, the third direction is a direction orthogonal to the first direction and the second direction.

Figure 3:
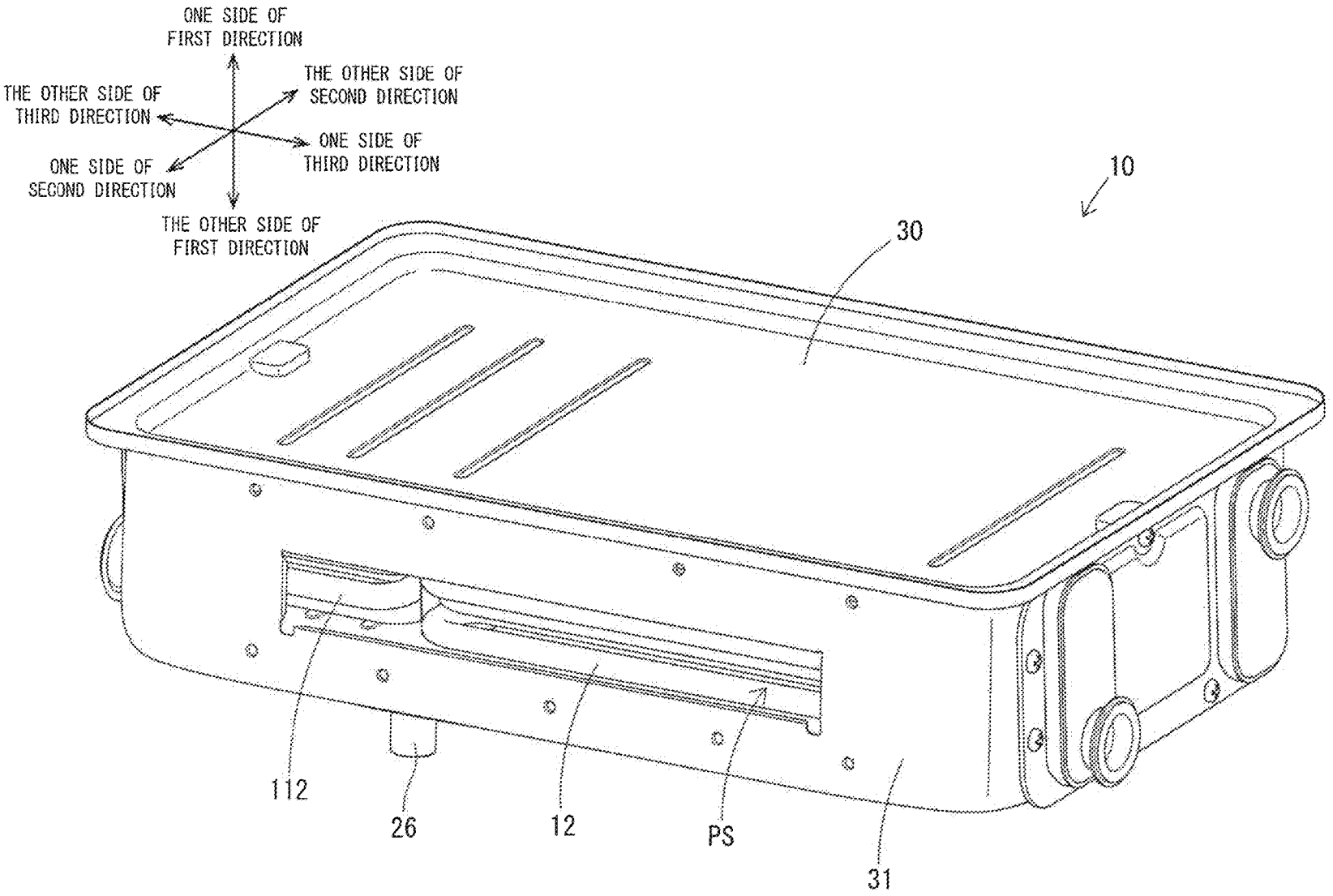
FIG. 3 is a perspective view schematically illustrating a secondary heat exchanger.

The secondary heat exchanger 10 corresponds to an example of a heat exchanger for a gas appliance and, as shown in FIG. 3, includes a case 30 and the first heat transfer tube portion 12.

The case 30 has a box body 31 that is long in the third direction, and an inside of the box body 31 is configured as a passage space PS for exhaust gas. The passage space PS is a space in the box body 31 and a space through which exhaust gas passes when the exhaust gas flows from a flow inlet 39 to a flow outlet 38.

Figure 4:
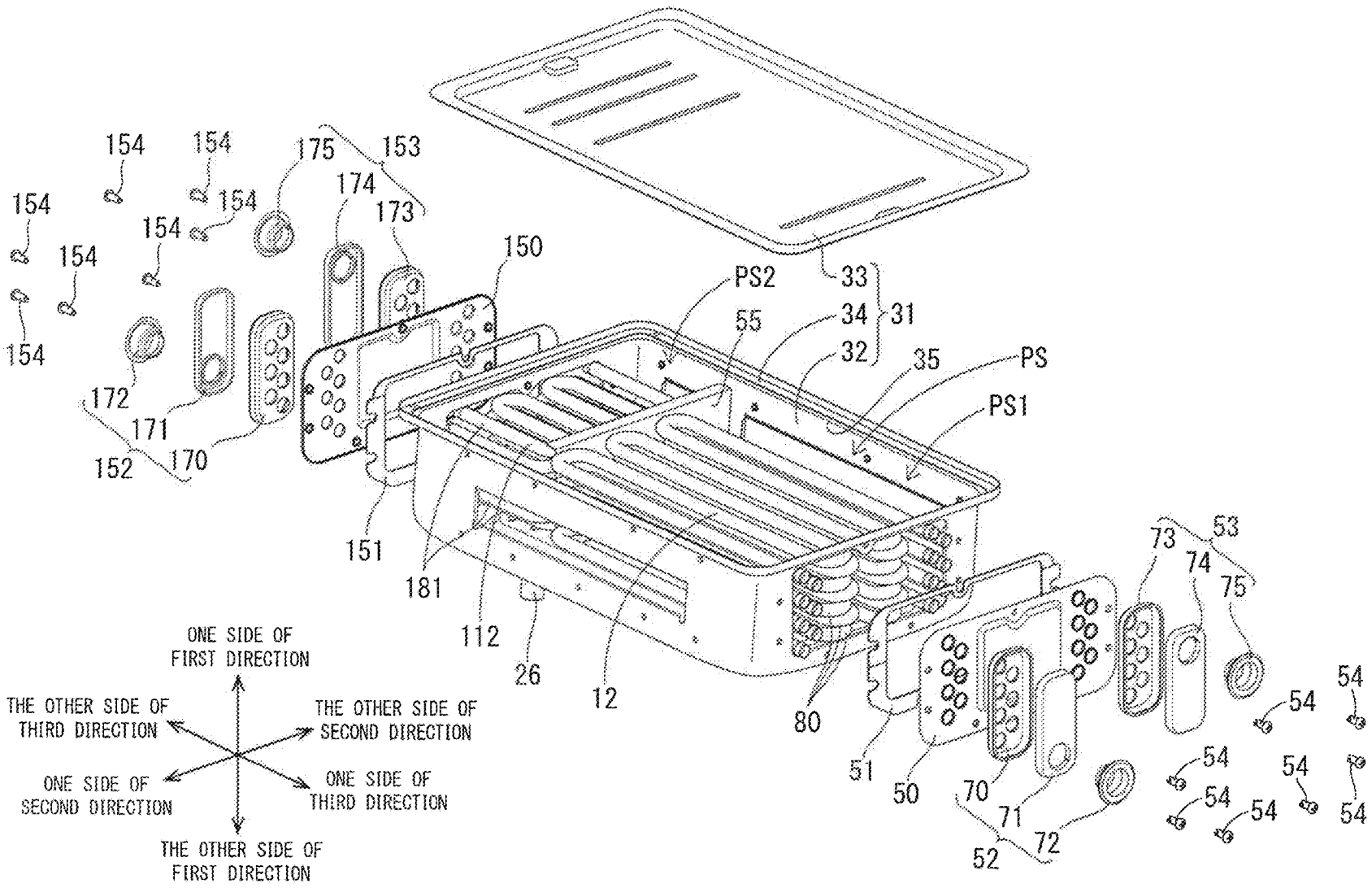
FIG. 4 is an exploded perspective view schematically illustrating the secondary heat exchanger.

As shown in FIG. 4, the box body 31 includes a main body portion 32, a lid portion 33, and a first seal member 34. The main body portion 32 is formed by drawing a metal plate in a box shape in which one side of the first direction is opened. That is, the main body portion 32 is configured as a drawing formed body. More specifically, the drawing process is a process in which a pressure is applied to a single metal plate to draw the metal plate into a concave shape. More specifically, the drawing formed body is a formed body that is formed by performing such drawing process on a metal plate. A first opening 35 is provided at an end of one side of the first direction in the main body portion 32. The lid portion 33 is a member that is attached to the main body portion 32 so as to close the first opening 35. The first seal member 34 is a member that is interposed between the main body portion 32 and the lid portion 33 and suppresses passage of gas between the main body portion 32 and the lid portion 33.

Figure 5:
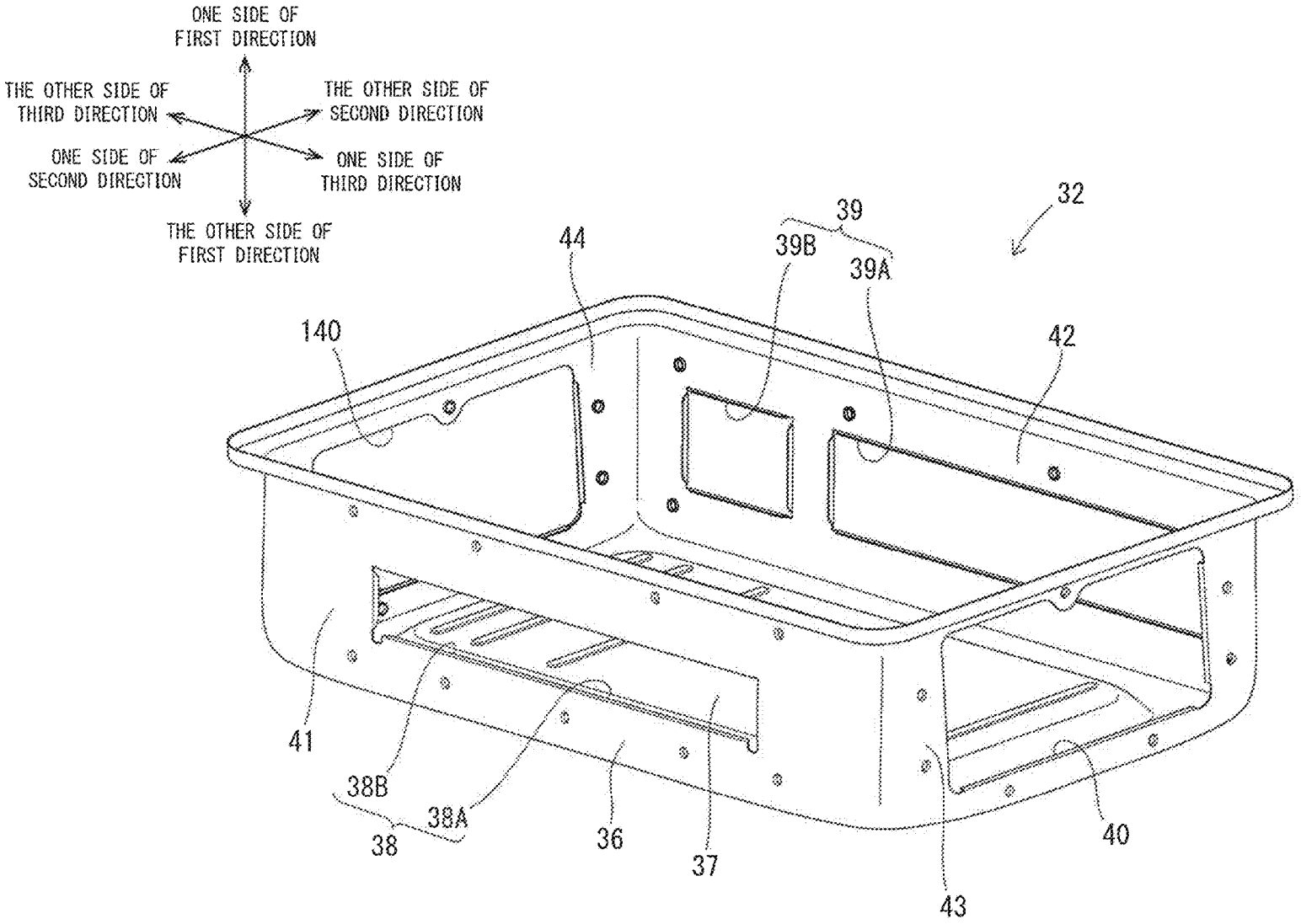
FIG. 5 is a perspective view schematically illustrating a main body portion.

As shown in FIG. 5, the main body portion 32 includes a peripheral wall portion 36 surrounding the passage space PS, and a bottom wall portion 37 connected to a lower end side of the peripheral wall portion 36. The bottom wall portion 37 is connected to a lower end portion of the peripheral wall portion 36 and is configured integrally with the peripheral wall portion 36.

In the peripheral wall portion 36, the flow outlet 38 for exhaust gas is provided on one side of the second direction, the flow inlet 39 for exhaust gas passing through the passage space PS is provided on the other side of the second direction, and a second opening 40 is provided on one side of the third direction. The peripheral wall portion 36 includes a first wall portion 41 constituting one side of the second direction, a second wall portion 42 constituting the other side of the second direction, a third wall portion 43 constituting one side of the third direction, and a fourth wall portion 44 constituting the other side of the third direction. The first wall portion 41 is provided with the flow outlet 38 described above. The second wall portion 42 is provided with the flow inlet 39 described above. The third wall portion 43 is provided with the second opening 40 described above. In the third wall portion 43, a plurality of first connected portions 45 are formed around the second opening 40. Each of the first connected portions 45 is a portion to which a first connecting member 54 described later is connected, and has a female screw shape.

The main body portion 32 is disposed in a state where the bottom wall portion 37 and the lid portion 33 are inclined downward from the flow inlet 39 side toward the flow outlet 38 side.

Figure 6:
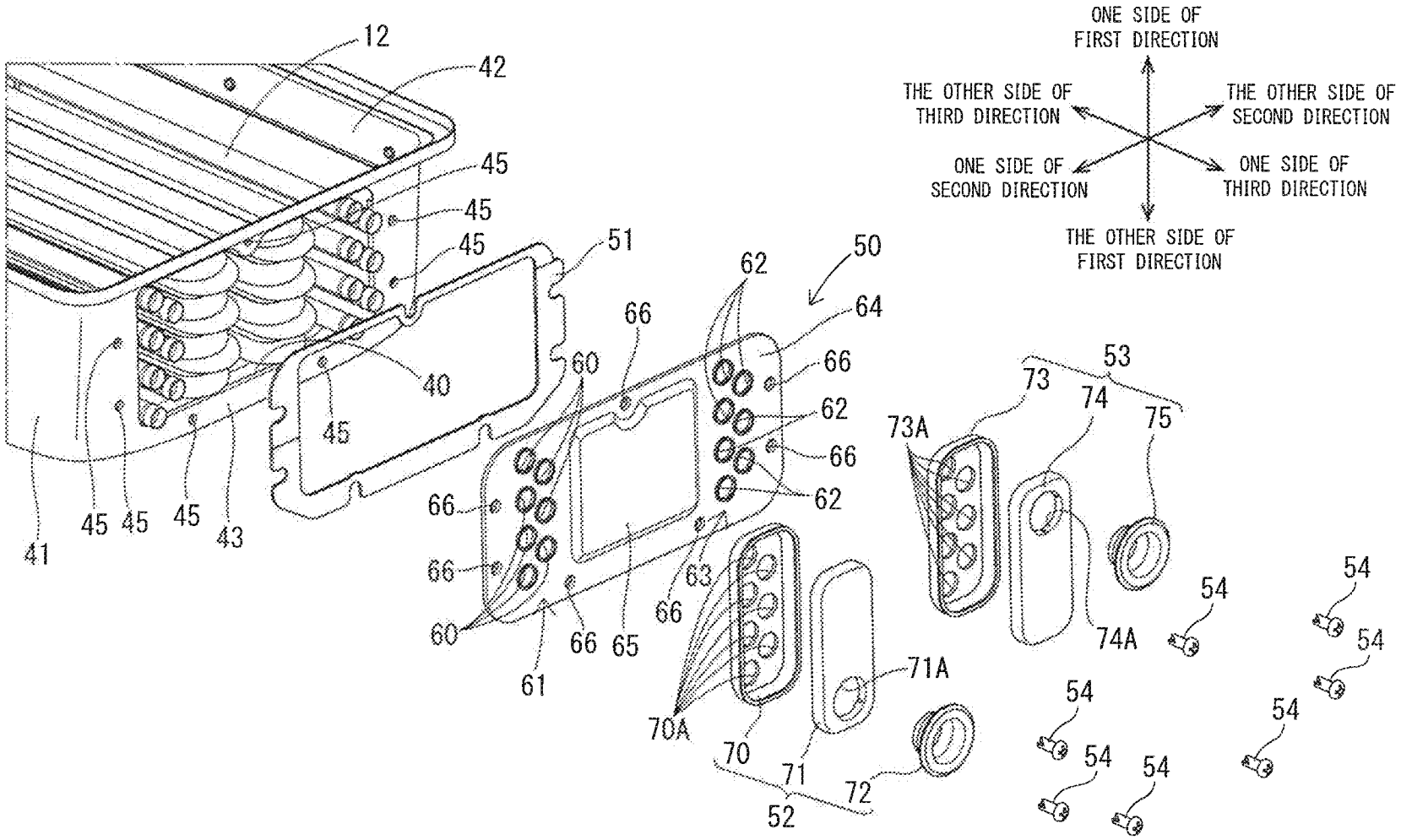
FIG. 6 is an exploded perspective view schematically illustrating one side of a third direction in the secondary heat exchanger.

As shown in FIGS. 4 and 6, the case 30 includes a first closing member 50, a second seal member 51, a first header 52, a second header 53, the first connecting member 54, the drain joint 26, and the like.

The first closing member 50 is a member that closes the second opening 40 of the main body portion 32, and has a plate shape. The first closing member 50 corresponds to an example of a closing member. The first closing member 50 includes a first through hole group 61 including a plurality of first through holes 60, a second through hole group 63 including a plurality of second through holes 62, a first plate-shaped portion 64, a first bulge portion 65, and a first insertion hole 66. The first through hole group 61 and the second through hole group 63 are arranged apart from each other in the second direction. The first through hole group 61 is arranged on one side of the second direction, and the second through hole group 63 is arranged on the other side of the second direction. The first through hole group 61 is arranged such that the positions of the first through holes 60 in the first direction are displaced from each other and such that the first through holes 60 are displaced in the second direction. Similarly to the first through hole group 61, the second through hole group 63 is arranged such that the positions of the second through holes 62 in the first direction are displaced from each other and such that the second through holes 62 are displaced in the second direction.

The first plate-shaped portion 64 is disposed along the first direction and the second direction. That is, the first plate-shaped portion 64 is disposed along a plane parallel to the first direction and the second direction. The first bulge portion 65 is provided substantially at the center of the first closing member 50 in the second direction, and has a shape bulging toward one side of the third direction relative to the first plate-shaped portion 64. The first insertion hole 66 is a hole through which the first connecting member 54 is inserted, and has a shape penetrating through the first closing member 50 (specifically, the first plate-shaped portion 64) in the third direction.

The first plate-shaped portion 64 is provided over both sides sandwiching the first bulge portion 65 at least in the second direction. The first through hole group 61 is formed in the first plate-shaped portion 64 on one side of the second direction relative to the first bulge portion 65. The first through holes 60 each have a common shape, are arranged such that the positions thereof in the first direction are displaced from each other, and arranged to be alternately displaced in the second direction. The second through hole group 63 is formed in the first plate-shaped portion 64 on the other side of the second direction relative to the first bulge portion 65. The second through holes 62 each have a common shape, are arranged such that the positions thereof in the first direction are displaced from each other, and are arranged to be alternately displaced in the second direction. Each of the second through holes 62 is arranged to be displaced in the first direction and the second direction in the same manner as each of the first through holes 60.

The second seal member 51 has an annular shape, is interposed between the box body 31 and the first closing member 50, and is a member that suppresses passage of gas between the box body 31 and the first closing member 50.

The first header 52 is a part that connects the upstream side of the first heat transfer tube portion 12 (specifically, the first heat transfer tube 80) and the downstream side of a pipe (specifically, the water inflow tube 4) on the water inlet 16 side. That is, the upstream side of the first heat transfer tube portion 12 (specifically, the first heat transfer tube 80) is connected to the downstream side of the pipe (specifically, the water inflow tube 4) on the water inlet 16 side via the first header 52. The first header 52 includes a first header body 70, a first header lid 71, and a first joint cylinder 72. The first header body 70 has a vessel-like shape opened on one side and has a first bottom hole 70A formed in a bottom surface. The first bottom hole 70A is provided corresponding to each position of the first through holes 60. The first header lid 71 is a member that closes an opening on one side of the first header body 70 by being attached to the first header body 70, and has a first lid hole 71A. The first lid hole 71A has an opening area larger than that of the first through hole 60, and is provided on the other side of the first direction in the first header lid 71. The first joint cylinder 72 is a member that is attached to the first header lid 71 so that the inside of the first joint cylinder 72 communicates with the first lid hole 71A and to which the downstream side of the pipe (specifically, the water inflow tube 4) on the water inlet 16 side is connected. The first header 52 is assembled by attaching the first header lid 71 to the first header body 70 and attaching the first joint cylinder 72 to the first header lid 71.

The second header 53 is a part that connects the downstream side of the first heat transfer tube portion 12 (specifically, the first heat transfer tube 80) and the upstream side of a pipe (specifically, the first connecting tube 15) on the hot-water outlet 18 side. That is, the downstream side of the first heat transfer tube portion 12 (specifically, the first heat transfer tube 80) is connected to the upstream side of the pipe (specifically, the first connecting tube 15) on the hot-water outlet 18 side via the second header 53. The second header 53 includes a second header body 73, a second header lid 74, and a second joint cylinder 75. The second header body 73 has a vessel-like shape opened on one side and has a second bottom hole 73A formed in a bottom surface. The second bottom hole 73A is provided corresponding to each position of the second through holes 62. The second header lid 74 is a member that closes an opening on one side of the second header body 73 by being attached to the second header body 73, and has a second lid hole 74A. The second lid hole 74A has an opening area larger than that of the second through hole 62, and is provided on one side of the first direction in the second header lid 74. The second lid hole 74A is provided on one side of the first direction relative to the first lid hole 71A. The second joint cylinder 75 is a member that is attached to the second header lid 74 so that the inside of the second joint cylinder 75 communicates with the second lid hole 74A and to which the upstream side of the pipe (specifically, the first connecting tube 15) on the hot-water outlet 18 is connected. The second header 53 is assembled by attaching the second header lid 74 to the second header body 73 and attaching the second joint cylinder 75 to the second header lid 74. The second header body 73 has a common shape with the first header body 70, and the second joint cylinder 75 has a common shape with the first joint cylinder 72.

The first connecting member 54 is a member that connects the first closing member 50 to the box body 31, and is configured, for example, as a metal screw. Each of the first connecting members 54 is inserted into the first insertion hole 66 of the first closing member 50 and connected to the first connected portion 45. In a state where the first connecting members 54 are connected to the first connected portions 45, the first closing member 50 is in a state of being sandwiched between the box body 31 (specifically, the third wall portion 43) and screw heads of the first connecting members 54, and the first closing member 50 is thus connected to the box body 31 (specifically, the third wall portion 43).

The drain joint 26 is provided on a surface on one side of the second direction in the case 30 and on the other side of the first direction in the case 30, and communicates with the passage space PS formed inside the case 30.

Figure 7:
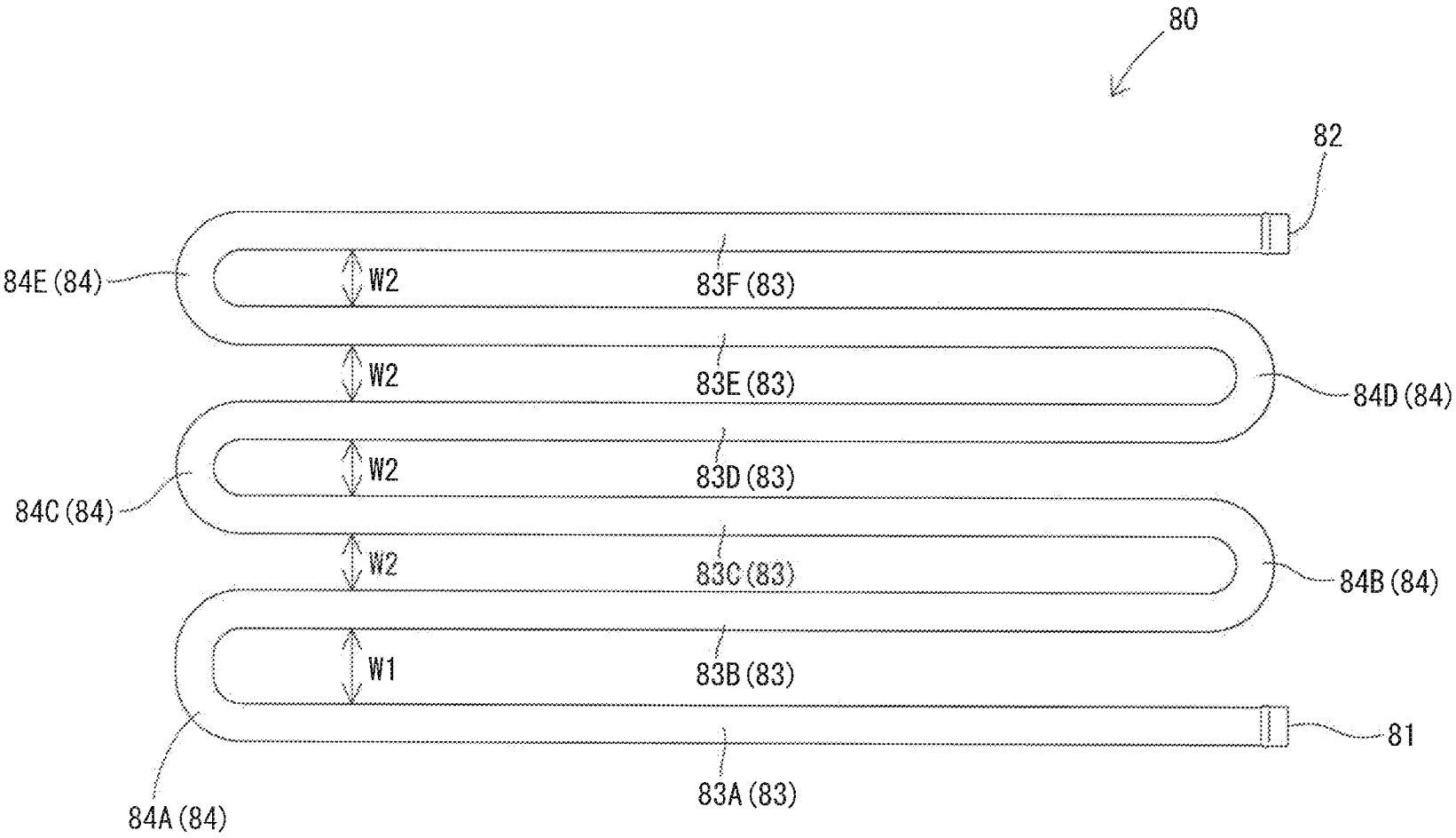
FIG. 7 is a plan view schematically illustrating a first heat transfer tube.

The first heat transfer tube portion 12 includes a plurality of first heat transfer tubes 80. The first heat transfer tube portion 12 corresponds to an example of a heat transfer tube portion. The first heat transfer tube 80 corresponds to an example of a heat transfer tube. The first heat transfer tube 80 extends so as to meander along a predetermined plane direction. The first heat transfer tubes 80 each have a common shape. As shown in FIG. 7, the first heat transfer tube 80 includes a first connection portion 81, a second connection portion 82, a plurality of (six in this embodiment) first straight tube portions 83, and at least one (five in this embodiment) first bent portions 84.

The first heat transfer tube 80 has a rotationally asymmetrical shape with a center line in the arrangement direction of the first straight tube portions 83 as an axis. That is, when the first heat transfer tube 80 is rotated by 180° about the center line in the arrangement direction of the first straight tube portions 83, the shape viewed from the axial direction is different between before and after rotation.

The first connection portion 81 is a portion that is connected to an upstream-side pipe (specifically, the inflow tube 4) or a downstream-side pipe (specifically, the first connecting tube 15), and is provided on one end side of the first heat transfer tube 80. The second connection portion 82 is a portion that is connected to the upstream-side pipe (specifically, the inflow tube 4) or the downstream-side pipe (specifically, the first connecting tube 15), and is provided on the other end side of the first heat transfer tube 80. The first connection portion 81 and the second connection portion 82 are arranged apart from each other in the arrangement direction of the first straight tube portions 83, and are arranged on the same side in an extending direction of the first straight tube portion 83.

The first straight tube portions 83 are arranged in parallel to each other. The six first straight tube portions 83 shown in FIG. 7 are defined as first straight tube portions 83A, 83B, 83C, 83D, 83E, and 83F in this order from the first connection portion 81 side. The first straight tube portion 83 is disposed so as to extend along the third direction. The first straight tube portion 83A is connected to the first connection portion 81, and the first straight tube portion 83F is connected to the second connection portion 82.

The five first bent portions 84 shown in FIG. 7 are defined as first bent portions 84A, 84B, 84C, 84D, and 84E in this order from the first connection portion 81 side. The first bent portion 84 is a portion connecting the first straight tube portions 83 to each other. The first bent portion 84A connects the first straight tube portions 83A and 83B to each other. The first bent portion 84B connects the first straight tube portions 83B and 83C to each other. The first bent portion 84C connects the first straight tube portions 83C and 83D to each other. The first bent portion 84D connects the first straight tube portions 83D and 83E to each other. The first bent portion 84E connects the first straight tube portions 83E and 83F to each other. The lengths of the first bent portions 84B, 84C, 84D, and 84E are the same in the arrangement direction of the first straight tube portions 83. The length of the first bent portion 84A is different from the lengths of the other first bent portions 84B, 84C, 84D, and 84E in the arrangement direction of the first straight tube portions 83. Specifically, the length of the first bent portion 84A is longer than the lengths of the other first bent portions 84B, 84C, 84D, and 84E in the arrangement direction of the first straight tube portions 83. Among the plurality of first bent portions 84, the even-numbered first bent portion 84 (specifically, the first bent portions 84B and 84D) is disposed close to the first closing member 50 as compared with the odd-numbered first bent portion 84 from the first connection portion 81 side (specifically, the first bent portions 84A, 84C, and 84E).

A gap interval between the first straight tube portion 83A and the first straight tube portion 83B is W1, and is longer than a gap interval W2 between the other first straight tube portions 83 (specifically, a gap interval W2 between the first straight tube portion 83B and the first straight tube portion 83C, a gap interval W2 between the first straight tube portion 83C and the first straight tube portion 83D, a gap interval W2 between the first straight tube portion 83D and the first straight tube portion 83E, and a gap interval W2 between the first straight tube portion 83E and the first straight tube portion 83F).

As shown in FIG. 5, the other side of the third direction (specifically, the fourth wall portion 44) in the peripheral wall portion 36 is provided with a third opening 140 penetrating through the peripheral wall portion 36 (specifically, the fourth wall portion 44). In the fourth wall portion 44, a plurality of second connected portions 145 are formed around the third opening 140. Each of the second connected portions 145 is a portion to which a second connecting member 154 described later is connected, and has a female screw shape.

Figure 8:
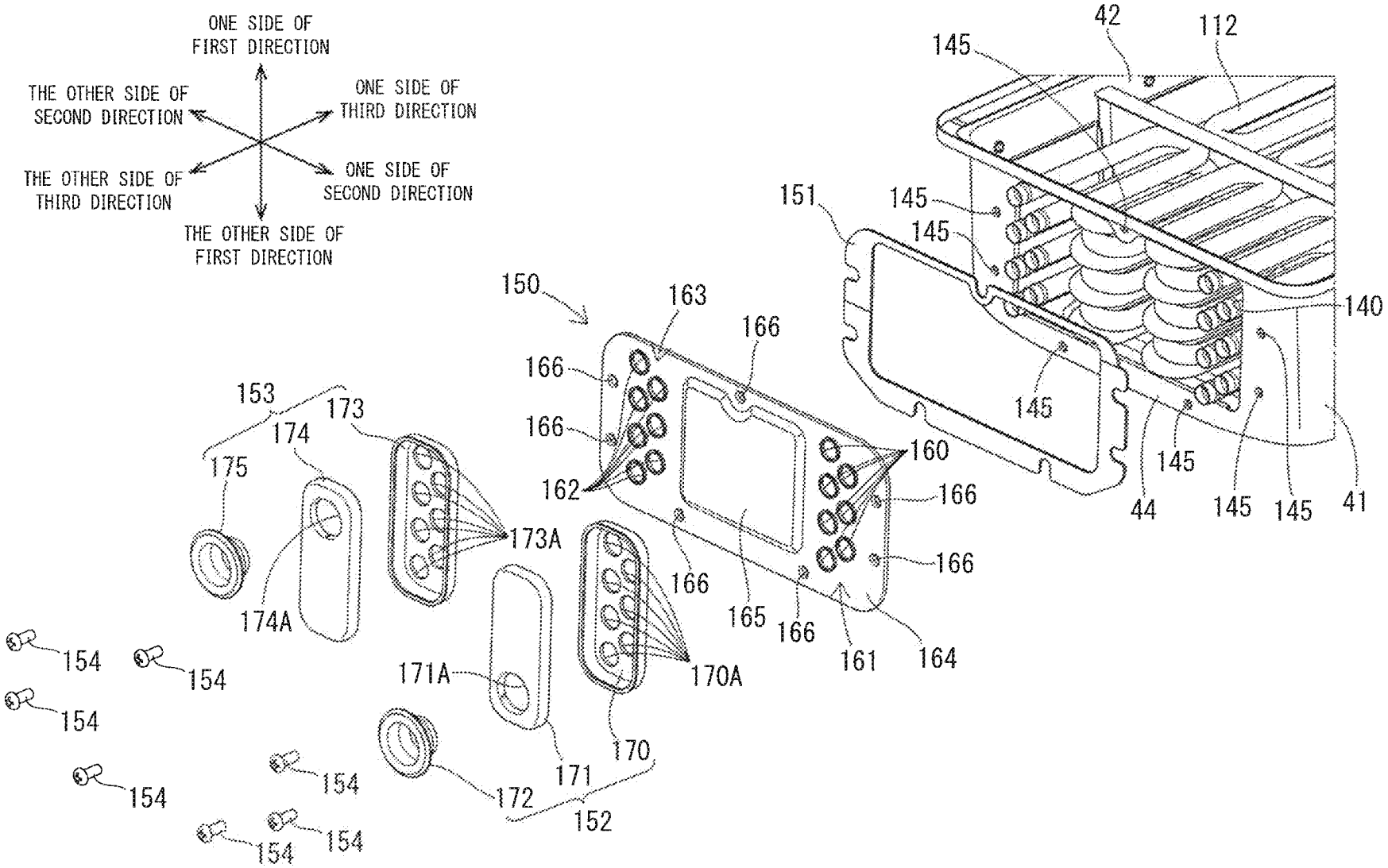
FIG. 8 is an exploded perspective view schematically illustrating the other side of the third direction in the secondary heat exchanger.

As shown in FIGS. 4 and 8, the case 30 includes a second closing member 150, a third seal member 151, a third header 152, a fourth header 153, the second connecting member 154, a partition plate 55, and the like. The secondary heat exchanger 10 includes the second heat transfer tube portion 112.

The second closing member 150 is a member that closes the third opening 140 of the main body portion 32, and has a plate shape. The second closing member 150 includes a third through hole group 161 including a plurality of third through holes 160, a fourth through hole group 163 including a plurality of fourth through holes 162, a second plate-shaped portion 164, a second bulge portion 165, and a second insertion hole 166. The second closing member 150 has a common shape with the first closing member 50.

The third through hole group 161 and the fourth through hole group 163 are arranged apart from each other in the second direction. The third through hole group 161 is arranged on one side of the second direction, and the fourth through hole group 163 is arranged on the other side of the second direction. The third through hole group 161 is arranged such that the positions of the third through holes 160 in the first direction are displaced from each other and such that the third through holes 160 are displaced in the second direction. Similarly to the third through hole group 161, the fourth through hole group 163 is arranged such that the positions of the fourth through holes 162 in the first direction are displaced from each other and such that the fourth through holes 162 are displaced in the second direction.

The second plate-shaped portion 164 is disposed along the first direction and the second direction. That is, the second plate-shaped portion 164 is disposed along a virtual plane parallel to the first direction and the second direction. The second bulge portion 165 is provided substantially at the center of the second closing member 150 in the second direction, and has a shape bulging toward the other side of the third direction relative to the second plate-shaped portion 164. The second insertion hole 166 is a hole through which the second connecting member 154 is inserted, and has a shape penetrating through the second closing member 150 (specifically, the second plate-shaped portion 164) in the third direction.

The second plate-shaped portion 164 is provided on both sides sandwiching the second bulge portion 165 at least in the second direction. The third through hole group 161 is formed in the second plate-shaped portion 164 on one side of the second direction relative to the second bulge portion 165. The third through holes 160 each have a common shape, are arranged such that the positions thereof in the first direction are direction are displaced from each other, and are arranged to be alternately displaced in the second direction. The fourth through hole group 163 is formed in the second plate-shaped portion 164 on the other side of the second direction relative to the second bulge portion 165. The fourth through holes 162 each have a common shape, are arranged such that the positions thereof in the first direction are displaced from each other, and are arranged to be alternately displaced in the second direction. Each of the fourth through holes 162 is arranged to be displaced in the first direction and the second direction in the same manner as each of the third through holes 160.

The third seal member 151 has an annular shape, is interposed between the box body 31 and the second closing member 150, and is a member that suppresses passage of gas between the box body 31 and the second closing member 150.

The third header 152 is a part that connects the upstream side of the second heat transfer tube portion 112 and the downstream side of a pipe (specifically, the outgoing pipe 104) on the inlet 116 side. That is, the upstream side of the second heat transfer tube portion 112 is connected to the downstream side of the pipe (specifically, the outgoing pipe 104) on the inlet 116 side via the third header 152. The third header 152 includes a third header body 170, a third header lid 171, and a third joint cylinder 172. The third header body 170 has a vessel-like shape opened on one side and has a third bottom hole 170A formed in a bottom surface. The third bottom hole 170A is provided corresponding to each position of the third through holes 160. The third header lid 171 is a member that closes an opening on one side of the third header body 170 by being attached to the third header body 170, and has a third lid hole 171A. The third lid hole 171A has an opening area larger than that of the third through hole 160, and is provided on the other side of the first direction in the third header lid 171. The third joint cylinder 172 is a member that is attached to the third header lid 171 so that the inside of the third joint cylinder 172 communicates with the third lid hole 171A and to which the downstream side of the pipe (specifically, the outgoing pipe 104) on the inlet 116 side is connected. The third header 152 is assembled by attaching the third header lid 171 to the third header body 170 and attaching the third joint cylinder 172 to the third header lid 171. The third header 152 has a common shape with the first header 52.

The fourth header 153 is a part that connects the downstream side of the second heat transfer tube portion 112 and the upstream side of a pipe (specifically, the second connecting tube 115) on the outlet 118 side. That is, the downstream side of the second heat transfer tube portion 112 is connected to the upstream side of the pipe (specifically, the second connecting tube 115) on the outlet 118 side via the fourth header 153. The fourth header 153 includes a fourth header body 173, a fourth header lid 174, and a fourth joint cylinder 175. The fourth header body 173 has a vessel-like shape opened on one side and has a fourth bottom hole 173A formed in a bottom surface. The fourth bottom hole 173A is provided corresponding to each position of the fourth through holes 162. The fourth header lid 174 is a member that closes an opening on one side of the fourth header body 173 by being attached to the fourth header body 173, and has a fourth lid hole 174A. The fourth lid hole 174A has an opening area larger than that of the fourth through hole 162, and is provided on one side of the first direction in the fourth header lid 174. The fourth lid hole 174A is provided on one side of the first direction relative to the third lid hole 171A. The fourth joint cylinder 175 is a member that is attached to the fourth header lid 174 so that the inside of the fourth joint cylinder 175 communicates with the fourth lid hole 174A and to which the upstream side of the pipe (specifically, the second connecting tube 115) on the outlet 118 is connected. The fourth header 153 is assembled by attaching the fourth header lid 174 to the fourth header body 173 and attaching the fourth joint cylinder 175 to the fourth header lid 174. The fourth header body 173 has a common shape with the third header body 170, and the fourth joint cylinder 175 has a common shape with the third joint cylinder 172. The fourth header 153 has a common shape with the second header 53.

The second connecting member 154 is a member that connects the second closing member 150 to the box body 31, and is configured, for example, as a metal screw. Each of the second connecting members 154 is inserted into the second insertion hole 166 of the second closing member 150 and connected to the second connected portion 145. In a state where the second connecting members 154 are connected to the second connected portions 145, the second closing member 150 is in a state of being sandwiched between the box body 31 (specifically, the fourth wall portion 44) and screw heads of the second connecting members 154, and the second closing member 150 is thus connected to the box body 31 (specifically, the fourth wall portion 44).

Figure 9:
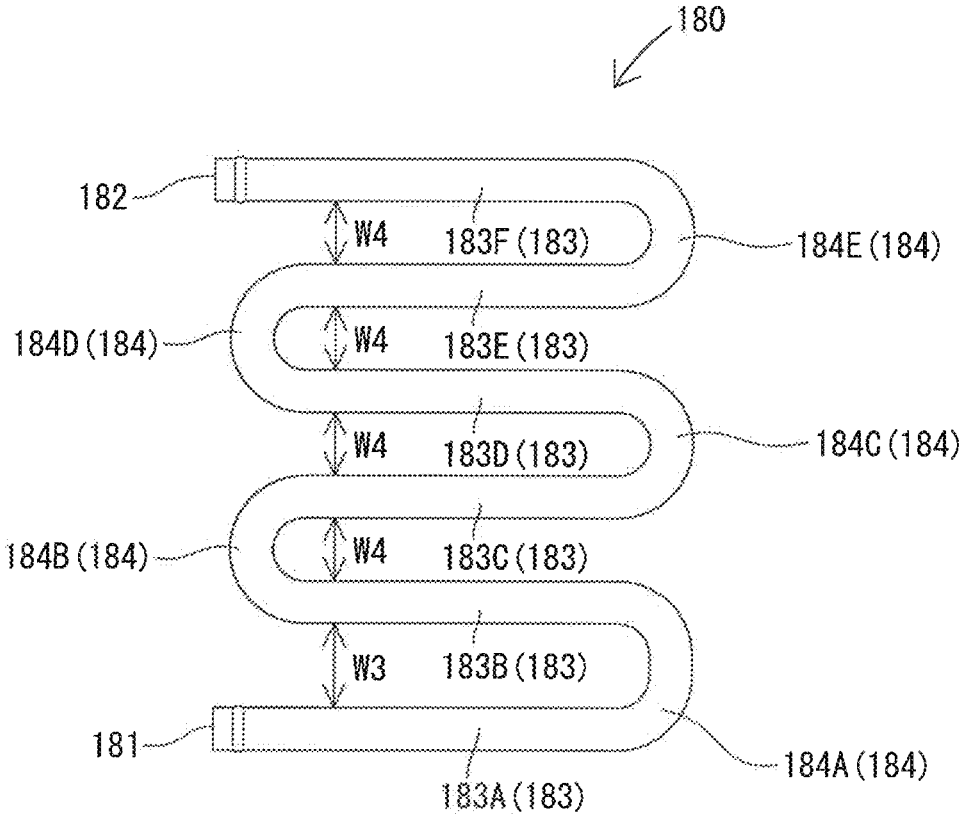
FIG. 9 is a plan view schematically illustrating a second heat transfer tube.

The second heat transfer tube portion 112 includes a plurality of second heat transfer tubes 180. The second heat transfer tube 180 extends so as to meander along a predetermined plane direction. The second heat transfer tubes 180 each have a common shape. As shown in FIG. 9, the second heat transfer tube 180 includes a third connection portion 181, a fourth connection portion 182, a plurality of (six in this embodiment) second straight tube portions 183, and at least one (five in this embodiment) second bent portions 184.

The second heat transfer tube 180 has a rotationally asymmetrical shape with a center line in the arrangement direction of the second straight tube portions 183 as an axis. That is, when the second heat transfer tube 180 is rotated by 180° about the center line in the arrangement direction of the second straight tube portions 183, the shape viewed from the axial direction is different between before and after rotation. The first heat transfer tube 80 and the second heat transfer tube 180 differ only in the length of the first straight tube portion 83 in the extending direction and the length of the second straight tube portion 183 in the extending direction, and other configurations (for example, the diameter of the tube, the length of the straight tube portion in the arrangement direction, the number of bent portions, etc.) are the same.

The third connection portion 181 is a portion that is connected to an upstream-side pipe (specifically, the outgoing pipe 104) or a downstream-side pipe (specifically, the second connecting tube 115), and is provided on one end side of the second heat transfer tube 180. The fourth connection portion 182 is a portion that is connected to an upstream-side pipe (specifically, the outgoing pipe 104) or a downstream-side pipe (specifically, the second connecting tube 115), and is provided on the other end side of the second heat transfer tube 180. The third connection portion 181 and the fourth connection portion 182 are arranged apart from each other in the arrangement direction of the second straight tube portions 183, and are arranged on the same side in an extending direction of the second straight tube portion 183.

The second straight tube portions 183 are arranged in parallel to each other. The six second straight tube portions 183 shown in FIG. 9 are defined as second straight tube portions 183A, 183B, 183C, 183D, 183E, and 183F in this order from the third connection portion 181 side. The second straight tube portion 183 is disposed so as to extend along the third direction. The second straight tube portion 183A is connected to the third connection portion 181, and the second straight tube portion 183F is connected to the fourth connection portion 182. The length of the second straight tube portion 183 is shorter than the length of the first straight tube portion 83. That is, the total length of the second heat transfer tube 180 is shorter than that of the first heat transfer tube 80.

The five second bent portions 184 shown in FIG. 9 are defined as second bent portions 184A, 184B, 184C, 184D, and 184E in this order from the third connection portion 181 side. The second bent portion 184 is a portion connecting the second straight tube portions 183 to each other. The second bent portion 184A connects the second straight tube portions 183A and 183B to each other. The second bent portion 184B connects the second straight tube portions 183B and 183C to each other. The second bent portion 184C connects the second straight tube portions 183C and 183D to each other. The second bent portion 184D connects the second straight tube portions 183D and 183E to each other. The second bent portion 184E connects the second straight tube portions 183E and 183F to each other. The lengths of the second bent portions 184B, 184C, 184D, and 184E are the same in the arrangement direction of the second straight tube portions 183. The length of the second bent portion 184A is different from the lengths of the other second bent portions 184B, 184C, 184D, and 184E in the arrangement direction of the second straight tube portions 183. Specifically, the length of the second bent portion 184A is longer than the lengths of the other second bent portions 184B, 184C, 184D, and 184E in the arrangement direction of the second straight tube portions 183. Among the plurality of second bent portions 184, the even-numbered second bent portion 184 (specifically, the second bent portions 184B and 184D) is disposed close to the second closing member 150 as compared with the odd-numbered second bent portion 184 from the third connection portion 181 side (specifically, the second bent portions 184A, 184C, and 184E).

A gap interval between the second straight tube portion 183A and the second straight tube portion 183B is W3, and is longer than a gap interval W4 between the other second straight tube portions 183 (specifically, a gap interval W4 between the second straight tube portion 183B and the second straight tube portion 183C, a gap interval W4 between the second straight tube portion 183C and the second straight tube portion 183D, a gap interval W4 between the second straight tube portion 183D and the second straight tube portion 183E, and a gap interval W4 between the second straight tube portion 183E and the second straight tube portion 183F).

The partition plate 55 is a member that partitions the inside of the box body 31. The flow outlet 38 described above functions as a first discharge region 38A and a second discharge region 38B for exhaust gas. The first discharge region 38A and the second discharge region 38B are provided side by side in the third direction. The second discharge region 38B is provided on the other side of the third direction with respect to the first discharge region 38A. The flow inlet 39 described above functions as a first inlet 39A and a second inlet 39B for exhaust gas. The first inlet 39A and the second inlet 39B are provided side by side in the third direction. The second inlet 39B is provided on the other side of the third direction with respect to the first inlet 39A. The partition plate 55 is disposed so as to partition a first passage space PS1 formed between the first inlet 39A and the flow outlet 38 (first discharge region 38A) and a second passage space PS2 formed between the second inlet 39B and the flow outlet 38 (second discharge region 38B). In the passage space PS, the first passage space PS1 is a space close to the second opening 40 relative to the partition plate 55. In the passage space PS, the second passage space PS2 is a space close to the third opening 140 relative to the partition plate 55.

The partition plate 55 includes a partition portion 56, a lower surface portion 57, and an upper surface portion 58. The partition portion 56 is a portion that partitions the first passage space PS1 and the second passage space PS2. The lower surface portion 57 is a portion connected to a lower end portion of the partition portion 56 and extending in a direction intersecting (for example, orthogonal to) the partition portion 56. The upper surface portion 58 is a portion connected to an upper end portion of the partition portion 56 and extending in the direction intersecting (for example, orthogonal to) the partition portion 56. The partition plate 55 is disposed in a state where the lower surface portion 57 is placed on an upper surface of the bottom wall portion 37.

Method of Manufacturing Secondary Heat Exchanger 10

Figure 10:
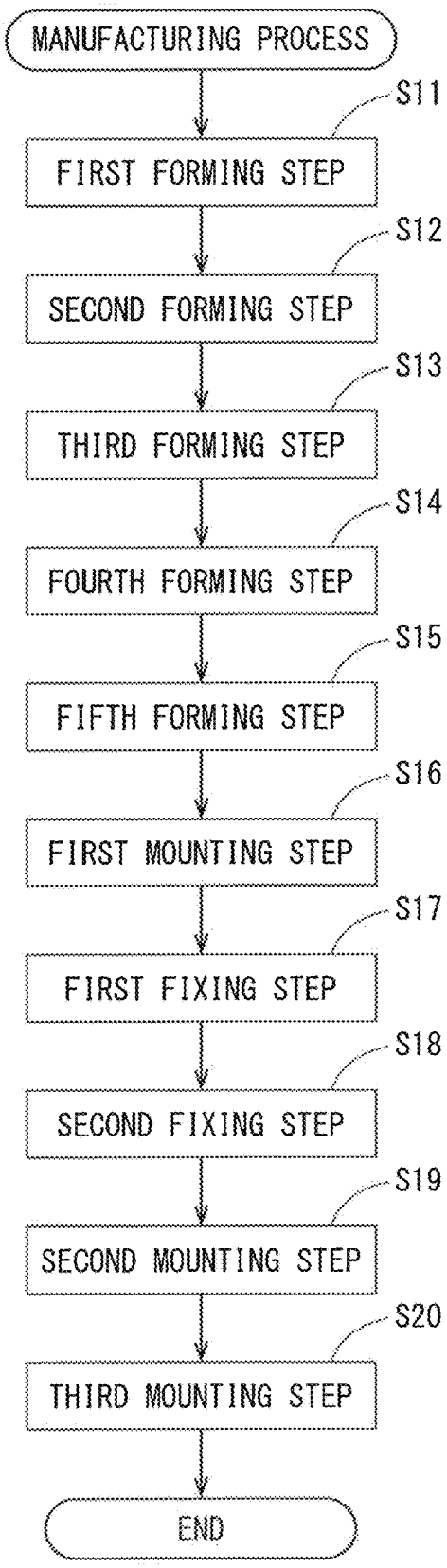
FIG. 10 is a flowchart illustrating a manufacturing process of the secondary heat exchanger.

Next, a method of manufacturing the secondary heat exchanger 10 will be described with reference to FIGS. 10, 11, and 12. As shown in the flowchart of FIG. 10, a method of manufacturing the secondary heat exchanger 10 includes a first forming step (step S11), a second forming step (step S12), a third forming step (step S13), a fourth forming step (step S14), a fifth forming step (step S15), a first mounting step (step S16), a first fixing step (step S17), a second fixing step (step S18), a second mounting step (step S19), and a third mounting step (step S20). Unless otherwise expressly limited, there are no limitations on the order in which each step is carried out.

In the first forming step, the main body portion 32 is formed by drawing a metal plate.

In the second forming step, in the peripheral wall portion 36, the flow outlet 38 that functions as the first discharge region 38A and the second discharge region 38B for exhaust gas is formed on one side of the second direction, the flow inlet 39 that functions as the first inlet 39A and the second inlet 39B for exhaust gas is formed on the other side of the second direction, the second opening 40 is formed on one side of the third direction, the third opening 140 is formed on the other side of the third direction. The first inlet 39A and the second inlet 39B are provided side by side in the third direction. The flow outlet 38, the flow inlet 39, the second opening 40, and the third opening 140 are formed by, for example, punching or cutting. In the present embodiment, the first discharge region 38A and the second discharge region 38B are integrally formed, but may be formed separately. In the present embodiment, the first inlet 39A and the second inlet 39B are formed separately, but may be a single inlet.

In the third forming step, the plate-shaped first closing member 50 is formed by processing a metal plate, for example. The first through hole group 61 provided with the plurality of first through holes 60 and the second through hole group 63 provided with the plurality of second through holes 62 are formed in the first closing member 50. The first through hole group 61 and the second through hole group 63 are arranged apart from each other in the second direction. The first insertion holes 66 are formed in the first closing member 50. The first through hole group 61, the second through hole group 63, and the first insertion holes 66 are formed by, for example, punching or cutting. The first bulge portion 65 is formed in the first closing member 50. The first bulge portion 65 is formed by drawing process, for example.

In the fourth forming step, the plate-shaped second closing member 150 is formed by processing a metal plate, for example. The second closing member 150 includes the third through hole group 161 including the plurality of third through holes 160 and the fourth through hole group 163 including the plurality of fourth through holes 162. The third through hole group 161 and the fourth through hole group 163 are arranged apart from each other in the second direction. The second insertion holes 166 are formed in the second closing member 150. The third through hole group 161, the fourth through hole group 163, and the second insertion holes 166 are formed by, for example, punching or cutting. The second bulge portion 165 is formed in the second closing member 150. The second bulge portion 165 is formed by drawing process, for example.

In the fifth forming step, the partition plate 55 that partitions the inside of the box body 31 is formed by processing a metal plate, for example. The lower surface portion 57 and the upper surface portion 58 of the partition plate 55 are formed by bending process, for example.

In the first mounting step, the partition plate 55 is mounted in the case 30 so that the first passage space PS1 and the second passage space PS2 are partitioned. The partition plate 55 is mounted in the case 30 by placing the lower surface portion 57 on the upper surface of the bottom wall portion 37.

Figure 11:
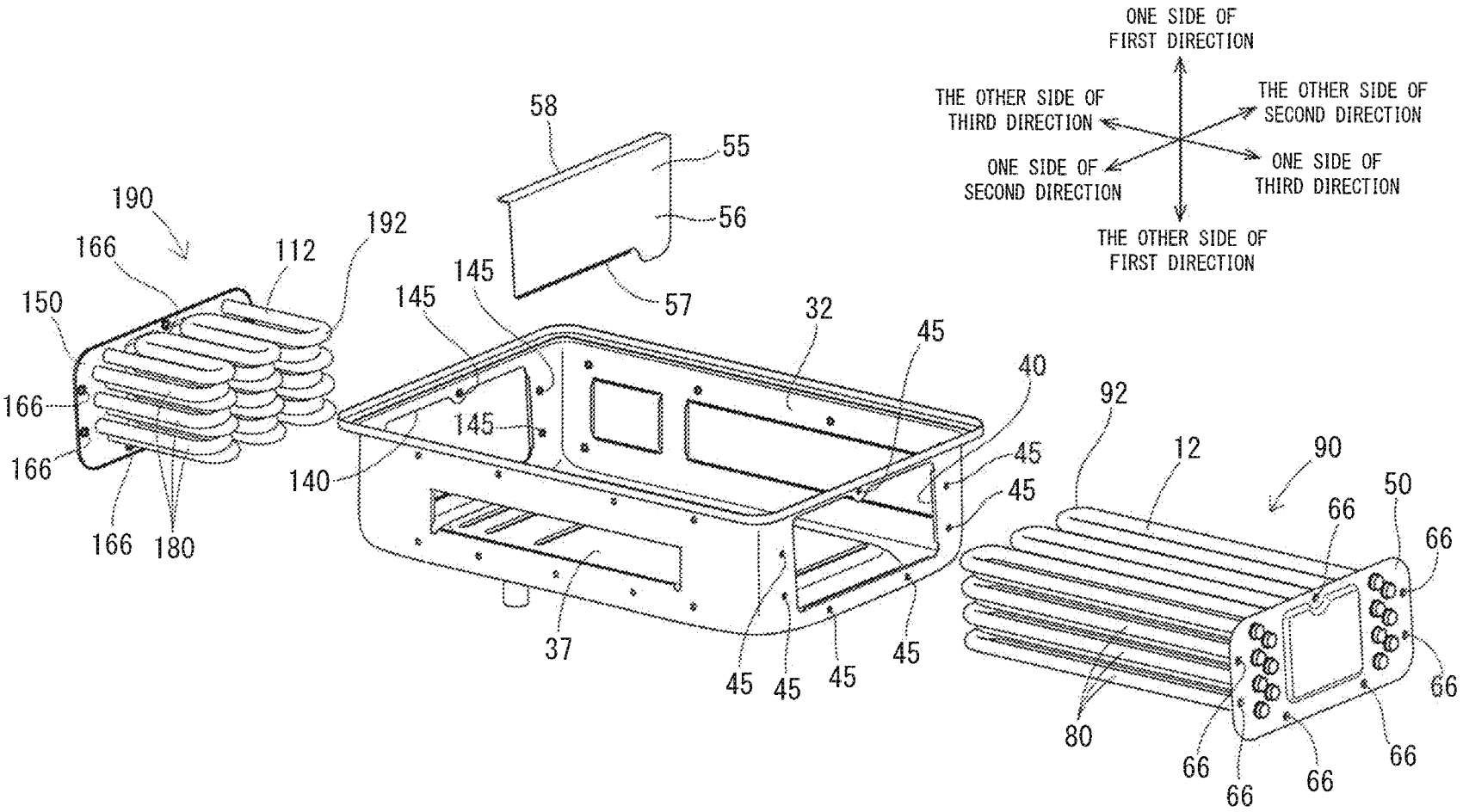
FIG. 11 is an explanatory diagram illustrating a state before a first assembly and a second assembly are attached to the main body portion.

In the first fixing step, as shown in FIG. 11, the plurality of first heat transfer tubes 80 is fixed to the first closing member 50 so that one side of each first heat transfer tube 80 in the second direction is mounted in association with each of the first through holes 60 of the first through hole group 61 and the other side of each first heat transfer tube 80 in the second direction is mounted in association with each of the second through holes 62 of the second through hole group 63. In the present embodiment, each of the first heat transfer tubes 80 is fixed to the first closing member 50 by, for example, welding or brazing in a state where an end of one side of each first heat transfer tube 80 in the second direction is inserted in each of the first through holes 60 of the first through hole group 61 and an end of the other side of each first heat transfer tube 80 in the second direction is inserted in each of the second through holes 62 of the second through hole group 63. Consequently, a first assembly 90 in which the first heat transfer tube portion 12 and the first closing member 50 are assembled integrally is produced. The first assembly 90 corresponds to an example of an assembly. The first heat transfer tubes 80 can be fixed to the first closing member 50 in a first posture in which the first connection portion 81 is disposed on one side of the second direction and the second connection portion 82 is disposed on the other side of the second direction, or in a second posture in which the second connection portion 82 is disposed on one side of the second direction and the first connection portion 81 is disposed on the other side of the second direction. The second posture can also be regarded as a posture in which the posture of the first connection portion 81 in the first posture is turned over. The plurality of first heat transfer tubes 80 is fixed to the first closing member 50 so that the first heat transfer tubes 80 in the first posture and the first heat transfer tubes 80 in the second posture are alternately arranged along the first direction. The first header 52 is fixed to the first heat transfer tube 80 by welding or brazing with each first bottom hole 70A of the first header 52 being inserted around each end of the first heat transfer tube 80 inserted through each of the first through holes 60 of the first through hole groups 61 (see FIGS. 3 and 12). The second header 53 is fixed to the first heat transfer tube 80 by welding or brazing with each second bottom hole 73A of the second header 53 being inserted around each end of the first heat transfer tube 80 inserted through each of the second through holes 62 of the second through hole groups 63 (see FIGS. 3 and 12).

In the second fixing step, as shown in FIG. 11, the plurality of second heat transfer tubes 180 is fixed to the second closing member 150 so that one side of each second heat transfer tube 180 in the second direction is mounted in association with each of the third through holes 160 of the third through hole group 161 and the other side each second heat transfer tube 180 in the second direction is mounted in association with each of the fourth through holes 162 of the fourth through hole group 163. In the present embodiment, each of the second heat transfer tubes 180 is fixed to the second closing member 150 by, for example, welding or brazing in a state where an end of one side of each second heat transfer tube 180 in the second direction is inserted in each of the third through holes 160 of the third through hole group 161 and an end of the other side of each second heat transfer tube 180 in the second direction is inserted in each of the fourth through holes 162 of the fourth through hole group 163. Consequently, a second assembly 190 in which the second heat transfer tube portion 112 and the second closing member 150 are assembled integrally is produced. The second heat transfer tubes 180 can be fixed to the second closing member 150 in a third posture in which the third connection portion 181 is disposed on one side of the second direction and the fourth connection portion 182 is disposed on the other side of the second direction, or in a fourth posture in which the fourth connection portion 182 is disposed on one side of the second direction and the third connection portion 181 is disposed on the other side of the second direction. The fourth posture can also be regarded as a posture in which the posture of the third connection portion 181 in the third posture is turned over. The plurality of second heat transfer tubes 180 is fixed to the second closing member 150 so that the second heat transfer tubes 180 in the third posture and the second heat transfer tubes 180 in the fourth posture are alternately arranged along the first direction. The third header 152 is fixed to the second heat transfer tube 180 by welding or brazing with each third bottom hole 170A of the third header 152 being inserted around each end of the second heat transfer tube 180 inserted through each of the third through holes 160 of the third through hole groups 161. The fourth header 153 is fixed to the second heat transfer tube 180 by welding or brazing with each fourth bottom hole 173A of the fourth header 153 being inserted around each end of the second heat transfer tube 180 inserted through each of the fourth through holes 162 of the fourth through hole groups 163.

Figure 12:
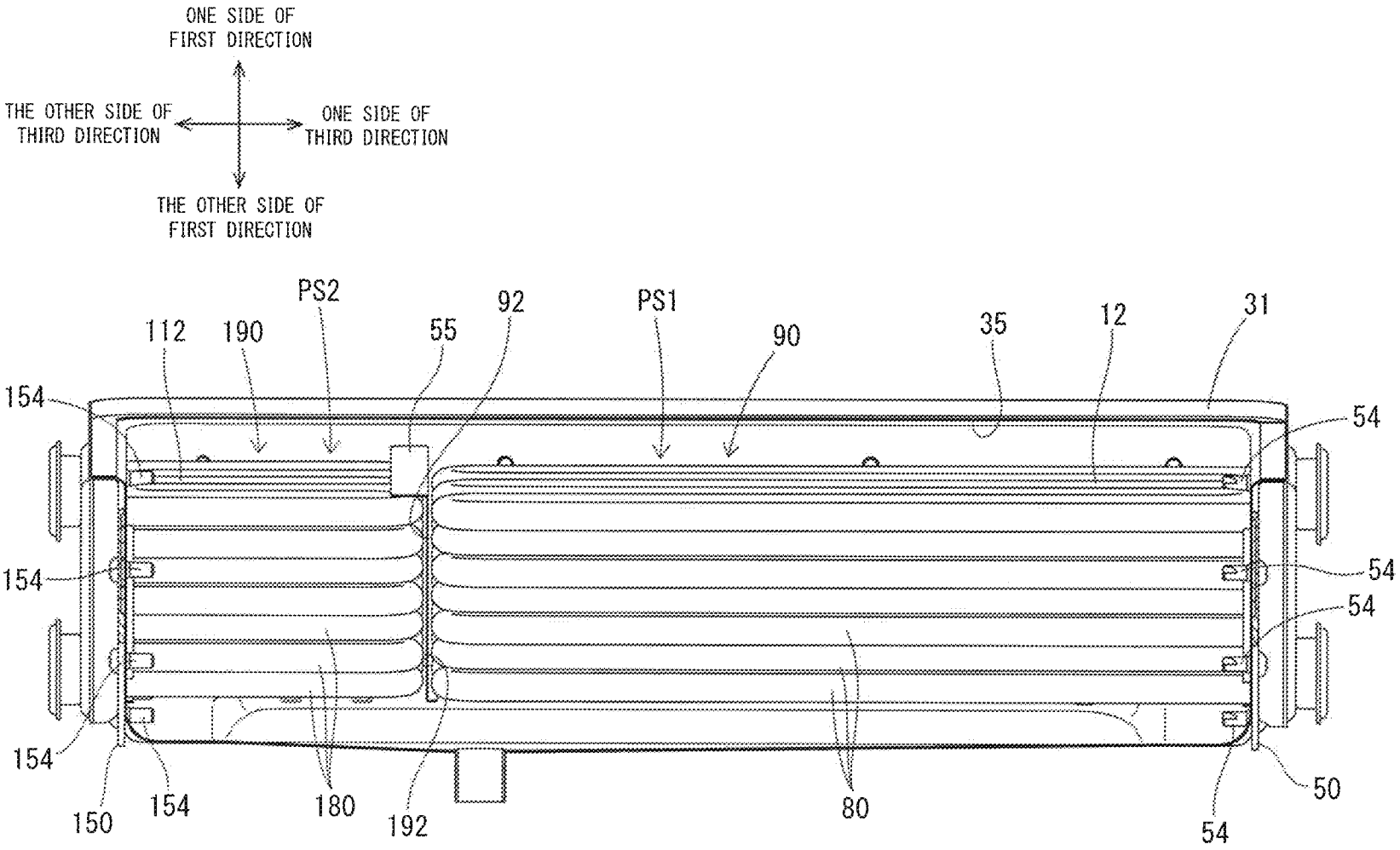
FIG. 12 is a cross-sectional view illustrating a state in which a cut surface taken along a plane along a first direction and the third direction is seen from the one side of a second direction in a state where the first assembly and the second assembly are attached to the main body portion.

In the second mounting step, as shown in FIG. 12, the first assembly 90 in which the first heat transfer tube portion 12 and the first closing member 50 are assembled integrally is mounted to the box body 31 in such a manner that the first heat transfer tube portion 12 is inserted into the box body 31 from the second opening 40 and the second opening 40 is closed by the first closing member 50. Specifically, the first heat transfer tube portion 12 is inserted into the box body 31 from the second opening 40, the second opening 40 is closed by the first closing member 50, and the first connecting members 54 inserted through the first insertion holes 66 of the first closing member 50 are connected to the first connected portions 45. Thus, the first assembly 90 is mounted to the box body 31. At this time, a first end 92 of the first heat transfer tube portion 12 which is an end on the opposite side to the first closing member 50 side is made to face the partition portion 56 of the partition plate 55 in the first passage space PS1, and the first end 92 is brought close to the partition portion 56. Each of the first heat transfer tubes 80 is disposed in a state where one side of the second direction is inclined to the other side of the first direction.

In the third mounting step, as shown in FIG. 12, the second assembly 190 in which the second heat transfer tube portion 112 and the second closing member 150 are assembled integrally is mounted to the box body 31 in such a manner that the second heat transfer tube portion 112 is inserted into the box body 31 from the third opening 140 and the third opening 140 is closed by the second closing member 150. Specifically, the second heat transfer tube portion 112 is inserted into the box body 31 from the third opening 140, the third opening 140 is closed by the second closing member 150, and the second connecting members 154 inserted through the second insertion holes 166 of the second closing member 150 are connected to the second connected portions 145. Thus, the second assembly 190 is mounted to the box body 31. At this time, a second end 192 of the second heat transfer tube portion 112 which is an end on the opposite side to the second closing member 150 side is made to face the partition portion 56 of the partition plate 55 in the second passage space PS2, and the second end 192 is brought close to the partition portion 56. Each of the second heat transfer tubes 180 is disposed in a state where one side of the second direction is inclined to the other side of the first direction.

By performing these steps, the secondary heat exchanger 10 is completed.

Effect

In the secondary heat exchanger 10, heat energy of exhaust gas passing through the first passage space PS1 is transmitted via the first heat transfer tube portion 12 to the water in the first heat transfer tube portion 12, and the water in the first heat transfer tube portion 12 is heated. Further, since heat energy of exhaust gas passing through the second passage space PS2 is transmitted via the second heat transfer tube portion 112 to the water passing in the second heat transfer tube portion 112, the water passing in the second heat transfer tube portion 112 can be heated.

In addition, in the secondary heat exchanger 10, the box body 31 including the passage space PS (the first passage space PS1 and the second passage space PS2) is constituted by closing the first opening 35 of the main body portion 32 which is configured as a drawing formed body, by the lid portion 33. Thus, the box body 31 is easily assembled.

In addition, the plurality of first heat transfer tubes 80 is fixed to the first closing member 50 so that one side of each first heat transfer tube 80 in the second direction is mounted in association with each of the first through holes 60 of the first through hole group 61 and the other side of each first heat transfer tube 80 in the second direction is mounted in association with each of the second through holes 62 of the second through hole group 63.

The first assembly 90 in which the first heat transfer tube portion 12 and the first closing member 50 are assembled integrally is mounted to the box body 31 in such a manner that the plurality of first heat transfer tubes 80 is inserted into the box body 31 from the second opening 40 and such a manner that the second opening 40 is closed by the first closing member 50.

Thus, the first end 92 which is on the other side of the third direction in the first heat transfer tube portion 12 can be disposed so as to face the partition plate 55 partitioning the first passage space PS1 and the second passage space PS2 and to be close to the partition plate 55. That is, according to the secondary heat exchanger 10, it is possible to fill a space in the third direction in the passage space PS (the first passage space PS1 and the second passage space PS2) without providing a member for filling the space. Therefore, it is possible to suppress an increase of dead space and thereby suppress a decrease in thermal efficiency.

In the manufacturing method described above, the main body portion 32 is formed by drawing process, and the box body 31 is constituted by closing the first opening 35 of the main body portion 32 by the lid portion 33. Thus, the box body 31 is easily assembled.

In addition, the plurality of first heat transfer tubes 80 is fixed to the first closing member 50 so that one side of each first heat transfer tube 80 in the second direction is mounted in association with each of the first through holes 60 of the first through hole group 61 and the other side of each first heat transfer tube 80 in the second direction is mounted in association with each of the second through holes 62 of the second through hole group 63. The plurality of second heat transfer tubes 180 is fixed to the second closing member 150 so that one side of each second heat transfer tube 180 in the second direction is mounted in association with each of the third through holes 160 of the third through hole group 161 and the other side of each second heat transfer tube 180 in the second direction is mounted in association with each of the fourth through holes 162 of the fourth through hole group 163.

The first assembly 90 in which the first heat transfer tube portion 12 and the first closing member 50 are assembled integrally is mounted to the box body 31 in such a manner that the plurality of first heat transfer tubes 80 is inserted into the box body 31 from the second opening 40 and such a manner that the second opening 40 is closed by the first closing member 50. The second assembly 190 in which the second heat transfer tube portion 112 and the second closing member 150 are assembled integrally is mounted to the box body 31 in such a manner that the plurality of second heat transfer tubes 180 is inserted into the box body 31 from the third opening 140 and such a manner that the third opening 140 is closed by the second closing member 150.

Thus, the first end 92 which is on the other side of the third direction in the first heat transfer tube portion 12 can be disposed close to the partition plate 55 partitioning the first passage space PS1 and the second passage space PS2, and, at the same time, the second end 192 which is on one side of the third direction in the second heat transfer tube portion 112 can be disposed close to the partition plate 55. That is, according to the secondary heat exchanger 10, it is possible to fill a space in the third direction in the passage space PS (the first passage space PS1 and the second passage space PS2) without providing a member for filling the space. Therefore, it is possible to suppress an increase of dead space and thereby suppress a decrease in thermal efficiency.

Other Embodiments

The present invention is not limited to the above embodiment, which has been described using the foregoing description and the drawings, and, for example, examples as described below are also encompassed within the technical scope of the present invention.

Figure 13:
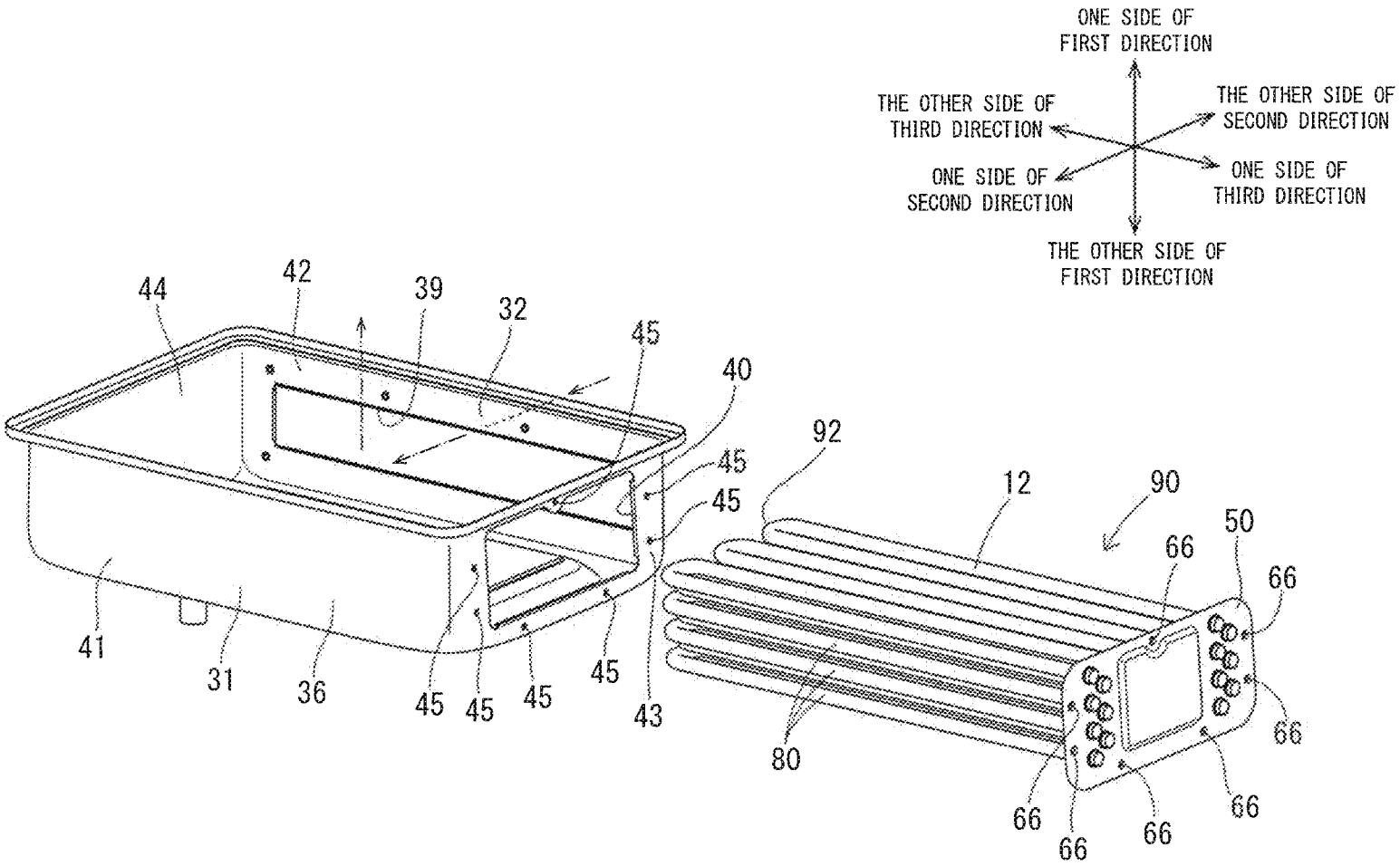
FIG. 13 is an explanatory diagram illustrating a state before an assembly is attached to the main body portion in another embodiment.

In the embodiment described above, the secondary heat exchanger 10 includes both of the first heat transfer tube portion 12 and the second heat transfer tube portion 112. However, only one of the first heat transfer tube portion 12 and the second heat transfer tube portion 112 may be provided. In this case, it is not necessary to provide the partition plate 55. For example, in a case of a first modification as shown in FIG. 13 in which only the first heat transfer tube portion 12 is provided out of the first heat transfer tube portion 12 and the second heat transfer tube portion 112, the third opening 140 need not be provided. In this first modification, the fourth wall portion 44 may only need to be configured such that the third opening 140 is closed (specifically, a configuration that the third opening 140 is closed such that a metal plate exists also in a region of the third opening 140). More specifically, the entire fourth wall portion 44 may only need to be configured as an integral side wall portion by a metal plate. Also in this first modification, the assembly 90 may only need to be mounted to the box body 31 in such a manner that the plurality of heat transfer tubes 80 is inserted into the box body 31 from the second opening 40 and such a manner that the second opening 40 is closed by the first closing member 50. In the configuration of the first modification, the size of the box body 31 in the third direction and the size of the heat transfer tube portion 12 in the third direction may only need to be adjusted to such a size that the first end 92 of the first heat transfer tube portion 12 faces the fourth wall portion 44 and the first end 92 and the fourth wall portion 44 are close to each other. In the first modification as shown in FIG. 13, gas that has entered from the flow inlet 39 passes the space in the box body 31 and flows out from the upper side (one side of the first direction). In this case, the lid portion 33 as shown in FIG. 4 (not shown in FIG. 13) may be formed with an opening.

When only the second heat transfer tube portion 112 is provided out of the first heat transfer tube portion 12 and the second heat transfer tube portion 112, the second opening 40 needs not be provided. In this case as well, modification may be carried out in the same manner as the first modification.

In the embodiment described above, although the secondary heat exchanger 10 is a heat exchanger for a gas appliance, the heat exchanger 8 may be the heat exchanger for a gas appliance, or the primary heat exchanger 9 may be the heat exchanger for a gas appliance.

What is claimed is:

1. A heat exchanger for a gas appliance comprising:

a case including a box body having a main body portion and a lid portion, the main body portion being configured as a drawing formed body and in a box shape in which one side of a first direction is opened, the main body portion including a first opening on one side of the first direction, the lid portion being configured to be attached to the main body portion so as to close the first opening, an inside of the box body being configured as a passage space for exhaust gas; and a heat transfer tube portion including a plurality of heat transfer tubes that is accommodated in the case, wherein the main body portion includes:

a peripheral wall portion surrounding the passage space; and a bottom wall portion connected to a lower end side of the peripheral wall portion, the peripheral wall portion includes a flow inlet for the exhaust gas that passes through the passage space, on an other side of the second direction intersecting the first direction, and a second opening on one side of a third direction intersecting the first direction and the second direction, the case includes a plate-shaped closing member, the closing member includes a first through hole group provided with a plurality of first through holes and a second through hole group provided with a plurality of second through holes, the first through hole group and the second through hole group being arranged apart from each other in the second direction, the plurality of heat transfer tubes is fixed to the closing member in such a configuration that one side of each of the heat transfer tubes in the second direction is mounted in association with each of the first through holes of the first through hole group and the other side of each of the heat transfer tubes in the second direction is mounted in association with each of the second through holes of the second through hole group, an assembly in which the heat transfer tube portion and the closing member are assembled integrally is mounted to the box body in such a configuration that the plurality of heat transfer tubes is inserted into the box body from the second opening and such a configuration that the second opening is closed by the closing member, and the peripheral wall portion has a first wall portion on one side of the second direction, a second wall portion on the other side of the second direction, a third wall portion on one side of the third direction, and a fourth wall portion on the other side of the third direction, the third wall portion includes the second opening, the heat exchanger further comprises an annular seal member and a connecting member, and the closing member is fixed to the third wall portion by the connecting member in such a configuration that the seal member is interposed between the box body and the closing member and the seal member suppresses passage of gas between the box body and the closing member.

2. A heat exchanger for a gas appliance comprising:

a case including a box body having a main body portion and a lid portion, the main body portion being configured as a drawing formed body and in a box shape in which one side of a first direction is opened, the main body portion including a first opening on one side of the first direction, the lid portion being configured to be attached to the main body portion so as to close the first opening, an inside of the box body being configured as a passage space for exhaust gas; and a first heat transfer tube portion including a plurality of first heat transfer tubes that is accommodated in the case; and a second heat transfer tube portion including a plurality of second heat transfer tubes that is accommodated in the case, wherein the main body portion includes:

a peripheral wall portion surrounding the passage space; and a bottom wall portion connected to a lower end side of the peripheral wall portion, the peripheral wall portion includes a flow inlet for the exhaust gas on an other side of a second direction intersecting the first direction, a second opening on one side of a third direction intersecting the first direction and the second direction, and a third opening on the other side of the third direction, the case includes a plate-shaped first closing member, a plate-shaped second closing member, and a partition plate that partitions the inside of the box body, the partition plate is disposed so as to partition a first passage space and a second passage space, the first passage space being formed on the second opening side in the third direction, the second passage space being formed on the third opening side in the third direction, the first closing member includes a first through hole group provided with a plurality of first through holes and a second through hole group provided with a plurality of second through holes, the first through hole group and the second through hole group being arranged apart from each other in the second direction, the second closing member includes a third through hole group provided with a plurality of third through holes and a fourth through hole group provided with a plurality of fourth through holes, the third through hole group and the fourth through hole group being arranged apart from each other in the second direction, the plurality of first heat transfer tubes is fixed to the first closing member in such a configuration that one side of each of the first heat transfer tubes in the second direction is mounted in association with each of the first through holes of the first through hole group and the other side of each of the first heat transfer tubes in the second direction is mounted in association with each of the second through holes of the second through hole group, the plurality of second heat transfer tubes is fixed to the second closing member in such a configuration that one side of each of the second heat transfer tubes in the second direction is mounted in association with each of the third through holes of the third through hole group and the other side of each of the second heat transfer tubes in the second direction is mounted in association with each of the fourth through holes of the fourth through hole group, a first assembly in which the first heat transfer tube portion and the first closing member are assembled integrally is mounted to the box body in such a configuration that the first heat transfer tube portion is inserted into the box body from the second opening and such a configuration that the second opening is closed by the first closing member and an end of the first heat transfer tube portion that is on an opposite side to the first closing member side is disposed close to the partition plate in the first passage space, a second assembly in which the second heat transfer tube portion and the second closing member are assembled integrally is mounted to the box body in such a configuration that the second heat transfer tube portion is inserted into the box body from the third opening and such a configuration that the third opening is closed by the second closing member and an end of the second heat transfer tube portion that is on an opposite side to the second closing member side is disposed close to the partition plate in the second passage space, and the peripheral wall portion has a first wall portion on one side of the second direction, a second wall portion on the other side of the second direction, a third wall portion on one side of the third direction, and a fourth wall portion on the other side of the third direction, the third wall portion includes the second opening, the heat exchanger further comprises an annular seal member and a connecting member, and the first closing member is fixed to the third wall portion by the connecting member in such a configuration that the seal member is interposed between the box body and the first closing member and the seal member suppresses passage of gas between the box body and the first closing member.

3. A method for manufacturing a heat exchanger for a gas appliance, the heat exchanger comprising a case and a heat transfer tube portion, the case including a box body having a main body portion and a lid portion, the main body portion being configured as a drawing formed body and in a box shape in which one side of a first direction is opened, the main body portion including a first opening on one side of the first direction, the lid portion being configured to be attached to the main body portion so as to close the first opening, an inside of the box body being configured as a passage space for exhaust gas, the heat transfer tube portion including a plurality of heat transfer tubes that is accommodated in the case, the method comprising:

a first forming step of forming the main body portion including a peripheral wall portion surrounding the passage space and a bottom wall portion connected to a lower end side of the peripheral wall portion, by drawing a metal plate, and forming the peripheral wall portion in such a configuration that the peripheral wall portion has a first wall portion on one side of the second direction, a second wall portion on the other side of the second direction, a third wall portion on one side of the third direction, and a fourth wall portion on the other side of the third direction;

a second forming step of, in the peripheral wall portion, forming a flow inlet for the exhaust gas on an other side of the second direction intersecting the first direction, and forming a second opening in the third wall portion on one side of a third direction intersecting the first direction and the second direction;

a third forming step of forming a plate-shaped closing member, the closing member being formed with a first through hole group provided with a plurality of first through holes and a second through hole group provided with a plurality of second through holes in such a configuration that the first through hole group and the second through hole group are apart from each other in the second direction;

a fixing step of fixing the plurality of heat transfer tubes to the closing member in such a configuration that one side of each of the heat transfer tubes in the second direction is mounted in association with each of the first through holes of the first through hole group and the other side of each of the heat transfer tubes in the second direction is mounted in association with each of the second through holes of the second through hole group; and a mounting step of mounting an assembly, in which the heat transfer tube portion and the closing member are assembled integrally, to the box body in such a configuration that the plurality of heat transfer tubes is inserted into the box body from the second opening and the second opening is closed by the closing member, and wherein in the mounting step, an annular seal member and a connecting member are used, and the closing member is fixed to the third wall portion by the connecting member in such a configuration that the seal member is interposed between the box body and the closing member and passage of gas between the box body and the closing member is suppressed by the seal member.

* * * * *